US010745999B2

(12) United States Patent
Massey

(10) Patent No.: US 10,745,999 B2
(45) Date of Patent: Aug. 18, 2020

(54) TOOL STRING ORIENTATION

(71) Applicant: Impact Selector International, LLC, Houma, LA (US)

(72) Inventor: James Patrick Massey, Breckenridge, CO (US)

(73) Assignee: IMPACT SELECTOR INTERNATIONAL, LLC, Houma, LA (US)

( * ) Notice: Subject to any disclaimer, the term of this patent is extended or adjusted under 35 U.S.C. 154(b) by 0 days.

(21) Appl. No.: 16/004,403

(22) Filed: Jun. 10, 2018

(65) Prior Publication Data

US 2018/0363423 A1 Dec. 20, 2018

Related U.S. Application Data

(60) Provisional application No. 62/517,280, filed on Jun. 9, 2017.

(51) Int. Cl.
*E21B 41/00* (2006.01)
*E21B 49/10* (2006.01)
(Continued)

(52) U.S. Cl.
CPC ..... *E21B 41/00* (2013.01); *E21B 17/1057* (2013.01); *E21B 17/1085* (2013.01);
(Continued)

(58) Field of Classification Search
CPC ..... E21B 23/14; E21B 2023/008; E21B 17/10
See application file for complete search history.

(56) References Cited

U.S. PATENT DOCUMENTS 1,517,027 A 11/1924 Smith
7,395,881 B2 † 7/2008 McKay
(Continued)

FOREIGN PATENT DOCUMENTS

GB 2430020 A 3/2007
WO 0140615 A1 6/2001
(Continued)

OTHER PUBLICATIONS

Stephen Mccormick et al; "Innovative Conveyance System Saves $9.4M on a Deep Water, High Angle Well in the Nam Con Son Basin", SPE, Mar. 21, 2017 (Mar. 21, 2017), XP055513400.
(Continued)

*Primary Examiner* — Tara Schimpf
*Assistant Examiner* — Dany E Akakpo
(74) *Attorney, Agent, or Firm* — Boisbrun Hofman, PLLC

(57) ABSTRACT

A downhole tool and method for orienting a tool string within a passage, such as a wellbore or a tubular disposed in the wellbore. The downhole tool may be operable for detachably connecting with the tool string and orienting the tool string within the passage. The downhole tool may include a frame comprising a first frame portion and a second frame portion, wherein the first and second frame portions may be detachably connectable with each other around the tool string to detachably connect the frame with the tool string. The downhole tool may further include a first orienting feature rotatably connected with the first frame portion along a first axis of rotation and a second orienting feature rotatably connected with the second frame portion along a second axis of rotation. The first and second axes of rotation may be radially offset from a central axis of the tool string.

22 Claims, 10 Drawing Sheets

(51) Int. Cl.

| | |
|---|---|
| ***E21B 17/10*** | (2006.01) |
| ***E21B 23/14*** | (2006.01) |
| ***E21B 47/01*** | (2012.01) |
| ***E21B 47/09*** | (2012.01) |

(52) U.S. Cl.
CPC ..... *E21B 23/14* (2013.01); *E21B 47/01* (2013.01); *E21B 47/09* (2013.01); *E21B 49/10* (2013.01)

(56) References Cited

U.S. PATENT DOCUMENTS

| | | | | |
|---|---|---|---|---|
| 2012/0145380 | A1* | 6/2012 | Draper | E21B 17/05 166/241.3 |
| 2012/0222857 | A1 | 9/2012 | McNay | |
| 2013/0248208 | A1 | 9/2013 | Copold et al. | |
| 2017/0067299 | A1† | 3/2017 | Copold | |
| 2018/0119498 | A1* | 5/2018 | Christie | E21B 23/14 |
| 2018/0135359 | A1 | 5/2018 | Hradecky et al. | |
| 2018/0328131 | A1* | 11/2018 | McCormick | F16N 17/00 |

FOREIGN PATENT DOCUMENTS

| | | | |
|---|---|---|---|
| WO | 2006016155 | A1 | 2/2006 |
| WO | 2016170356 | A1 | 10/2016 |
| WO | 2017014871 | A1 † | 1/2017 |

OTHER PUBLICATIONS

PCT/US2018/036938 International Search Report and Written Opinion of the ISA, dated Oct. 10, 2018, 16 pages.

PCT/US2016/037615 International Search Report and Written Opinion dated Aug. 23, 2016, 13 pages.

Petromac Ltd., Petromac 1, Jan. 21, 2016, Petromac Ltd., https://web.archive.org/web/20160121110834/http://petromac.co.nz/photographs.†

Petromac Ltd., Petromac 2, Jan. 21, 2016, Petromac Ltd., https://web.archive.org/web/20160121110834/http://petromac.co.nz/technical-specifications.†

* cited by examiner
† cited by third party

TOOL STRING ORIENTATION

CROSS-REFERENCE TO RELATED APPLICATIONS

This application claims priority to and the benefit of U.S. Provisional Application No. 62/517,280, titled "TOOL STRING ORIENTATION," filed Jun. 9, 2017, the entire disclosures of which are hereby incorporated herein by reference.

BACKGROUND OF THE DISCLOSURE

In the oil and gas industry, hydrocarbon reservoirs have conventionally been accessed by vertical or near-vertical wellbores. Such reservoirs, however, are increasingly accessed via non-vertical wellbores.

Tools that have conventionally been used in the vertical or near-vertical wellbores may encounter problems when used in the non-vertical wellbores. Such tools may be lowered into wellbores as part of a tool string utilizing gravity to facilitate transport or movement therethrough. In non-vertical wellbores, gravity may be negated by frictional forces between the tool string and sidewall of the wellbore, thus resisting movement of the tool string through the wellbore. Also, particularly with open-hole wellbores not lined with casing, outer surfaces of the tool string may stick to the sidewall of the wellbore, or edges of the tool string may dig into or jam against imperfections in the sidewall of the wellbore.

Furthermore, some downhole tools achieve optimal performance when oriented in a specific direction within the wellbore. For example, certain formation testing/sampling tools achieve optimal performance when a sensor/probe of the tool faces or even contacts an intended side of the non-vertical wellbore. However, friction caused by the non-vertical nature of the wellbore trajectory impedes intended axial rotation of the tool string relative to the wellbore. Moreover, wireline, coiled tubing, and/or other means of conveying the tool string within the wellbore are often unable to facilitate rotational orientation of the tool string relative to the wellbore, such that rotation of the conveyance means at the wellsite surface is not transferred downhole and imparted to the tool string in the wellbore. Some downhole roller tools facilitate movement of the tool string along non-vertical portions of the wellbore, however, such roller tools do not axially orient the tool string within and relative to the non-vertical wellbore portions.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
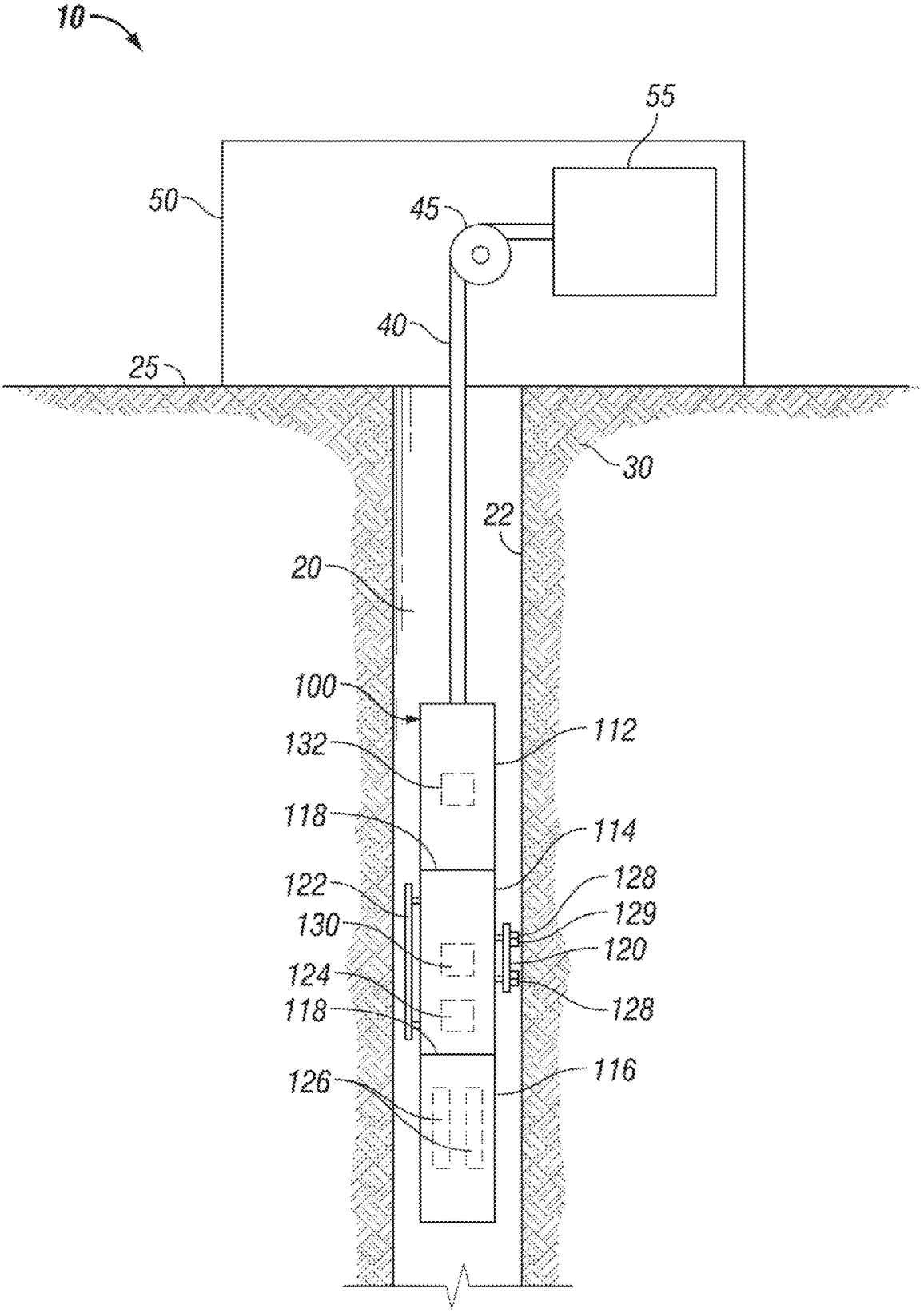
FIG. 1 (Prior Art)
FIG. 1 is a schematic view of prior art apparatus disposed in a substantially vertical wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of a prior art wellsite system 10 utilized in the oil and gas industry. The wellsite system 10 may comprise a tool string 100 suspended within a wellbore 20 that extends from a wellsite surface 25 into one or more subterranean formations 30. The tool string 100 may be suspended within the wellbore 20 via a conveyance means 40 operably coupled with a tensioning device 45 and/or other surface equipment 50 disposed at the wellsite surface 25, including a power and control system 55. The wellbore 20 is depicted as being an open-hole implementation lacking a casing and cement. However, one or more aspects of the present disclosure may be applicable to and/or readily adaptable for utilizing in cased-hole implementations comprising a casing secured by cement.

The tensioning device 45 may be operable to apply an adjustable tensile force to the tool string 100 via the conveyance means 40. The tensioning device 45 may be, comprise, or form at least a portion of a crane, a winch, a drawworks, a top drive, and/or other lifting device coupled to the tool string 100 via the conveyance means 40. The conveyance means 40 may be or comprise a wireline, a slickline, an e-line, a coiled tubing, and/or other conveyance means spooled at the wellsite surface 25, such as via or in conjunction with the tensioning device 45. The conveyance means 40 may comprise and/or be operable in conjunction with means for communication between the tool string 100, the tensioning device 45, and/or one or more other portions of the surface equipment 50, including the power and control system 55. Accordingly, the conveyance means 40 may also comprise a multi-conductor wireline, perhaps including one or more electrical and/or optical conductors, extending between the tool string 100 and the surface equipment 50.

The tool string 100 may comprise one or more portions, each of which may be, comprise, or form a portion of one or more downhole tools, modules, and/or other apparatus. For example, first, second, and third portions 112, 114, 116 of the tool string 100 may each be or comprise at least a portion of an acoustic tool, a density tool, a directional tool, an electromagnetic (EM) tool, a formation testing tool, a fluid sampling tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a telemetry tool, and/or a mechanical interface tool, among other examples also within the scope of the present disclosure. Although FIG. 1 depicts the tool string 100 comprising three portions 112, 114, 116, it is to be understood that the tool string 100 may comprise a different number of portions connected together to form the tool string 100.

The first, second, and third tool string portions 112, 114, 116 may be connected together, such as via threaded connections (not shown), to form the tool string 100. When connected together, the tool string portions 112, 114, 116 may form recesses or make-up grooves 118 adjacent the threaded connections or other connection means between the tool string portions 112, 114, 116. The make-up grooves 118 may extend radially inward with respect to an outer wall or surface of the tool string 100.

In an implementation of the wellsite system 10, the first portion 112 may be or comprise a telemetry tool 112, the second portion 114 may be or comprise a formation testing tool 114, and the third portion 116 may be or comprise a fluid sampling tool 116. Although the telemetry tool 112 is shown as being implemented separate from the formation testing tool 114, the telemetry tool 112 may be implemented as part of the formation testing tool 114.

The formation testing tool 114 may comprise a selectively extendable probe/sensor assembly 120 (referred to hereinafter as a "probe/sensor") and a selectively extendable anchoring member 122 that are respectively arranged on opposing sides of the formation testing tool 114. The probe/sensor 120 may be configured to selectively seal off or isolate selected portions of a sidewall 22 of the wellbore 20. For example, the probe/sensor 120 may comprise a sealing pad 129 that may be urged against the sidewall 22 in a sealing manner to prevent movement of fluid into or out of the selected portion of the formation 30 other than through the probe/sensor 120. The probe/sensor 120 may thus be configured to fluidly couple a pump 124 and/or other components of the formation testing tool 114 to the adjacent formation 30. Accordingly, the formation testing tool 114 may be utilized to obtain fluid samples from the formation 30 by extracting fluid from the formation 30 via the pump 124. A fluid sample may thereafter be expelled through a port (not shown) into the borehole 20, or the sample may be directed to one or more detachable fluid collecting chambers 126 disposed in the sampling tool 116. In turn, the detachable chambers 126 may receive and retain the formation fluid for subsequent testing at the wellsite surface 25, such as at a testing facility.

The formation testing tool 114 may also be utilized to inject fluid into the formation 30 by, for example, pumping the fluid from one or more fluid collecting chambers 126 disposed in the sample tool 116 via the pump 124. Moreover, although the tool string 100 is depicted as comprising one pump 124, the tool string 100 may comprise multiple pumps. The pump 124 may be or comprise a reversible pump configured to pump in two directions (e.g., into and out of the formation 30, into and out of the collecting chamber(s) 126 of the sample module).

The probe/sensor 120 may comprise one or more sensors 128 adjacent a port of the probe/sensor 120, among other possible locations. The sensors 128 may be operable in determining petrophysical parameters of a portion of the formation 30 proximate the probe/sensor 120. For example, the sensors 128 may be configured to measure, detect, and/or otherwise generate information related to one or more of pressure, temperature, composition, electric resistivity, dielectric constant, magnetic resonance relaxation time, nuclear radiation, and/or combinations thereof, although other types of sensors are also within the scope of the present disclosure.

The formation testing tool 114 may also comprise a fluid sensing unit 130 through which obtained fluid samples may flow, such as to measure properties and/or composition data of the sampled fluid. For example, the fluid sensing unit 130 may comprise one or more of a spectrometer, a fluorescence sensor, an optical fluid analyzer, a density and/or viscosity sensor, and/or a pressure and/or temperature sensor, among others.

The telemetry tool 112 and/or another portion of the tool string 100 may comprise a downhole controller and/or control system 132 communicatively coupled to the power and control system 55. The power and control system 55 and/or the downhole controller and/or control system 132 may be configured to control the probe/sensor 120 and/or the extraction of fluid samples from the formation 30, such as via a pumping rate of the pump 124. The power and control system 55 and/or the downhole controller and/or control system 132 may be further operable to analyze and/or process data obtained from sensors disposed in the fluid sensing unit 130 and/or the sensors 128, store measurements or processed data, and/or communicate the measurements or processed data to the power and control system 55 or another component of the surface equipment 50 for subsequent analysis.

The wellbore 20 containing the tool string 100 is shown as being substantially vertical, or perpendicular to the wellsite surface 25. The conveyance means 40 may be reeled into and out of the wellbore 20 such that gravity and the unreeled length of the conveyance means 40 primarily dictate the depth of the downhole tool string 100. In a substantially vertical wellbore, such as the wellbore 20 shown in FIG. 1, the vertical sidewall 22 may not appreciably impede the intended conveyance or movement of the downhole tool string 100 within the wellbore 20. However, this may not be true for non-vertical wellbores.

Figure 2:
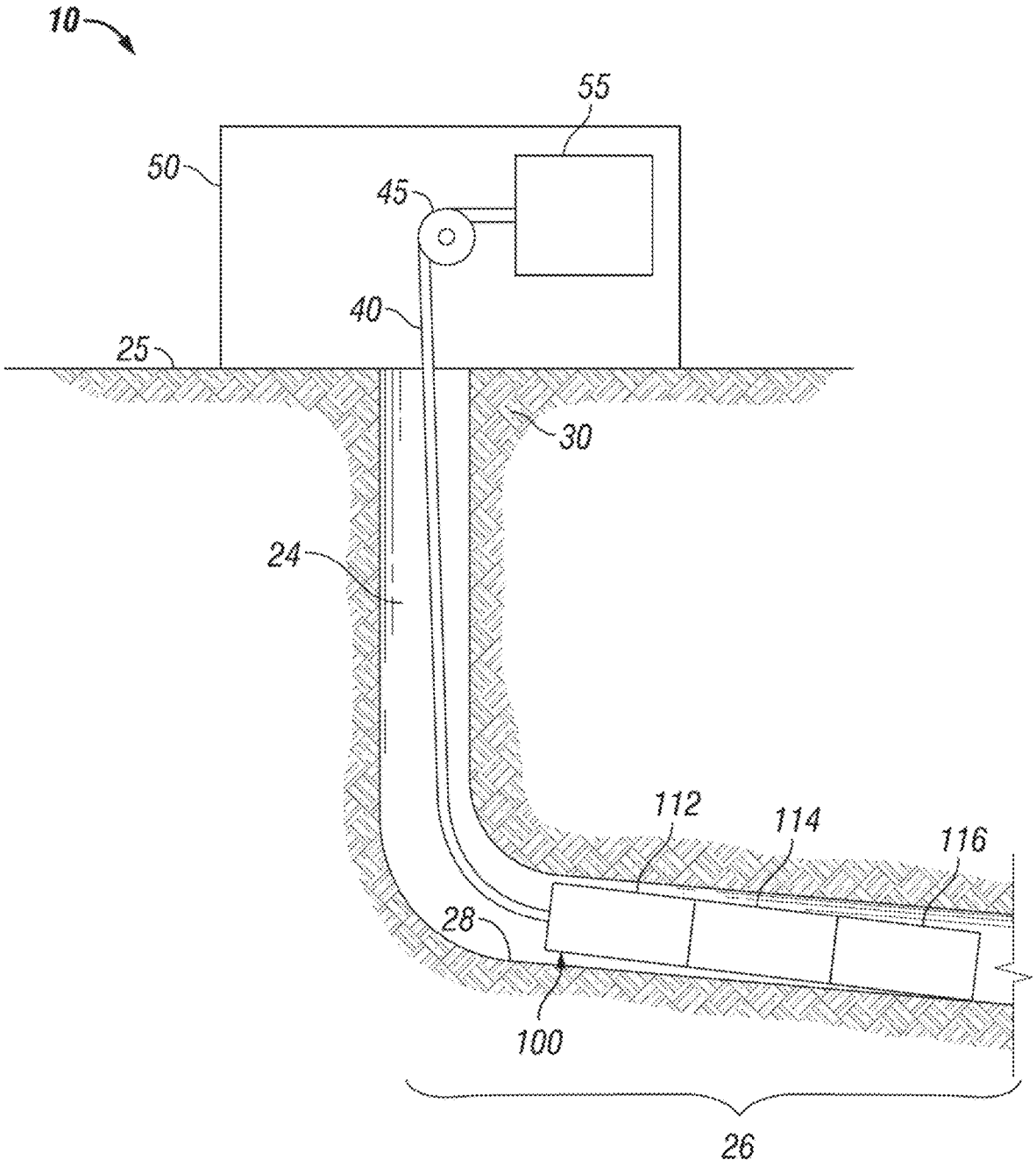
FIG. 2 (Prior Art)
FIG. 2 is a schematic view of the prior art apparatus shown in FIG. 1 disposed in a substantially non-vertical wellbore.

Wells being drilled today are increasingly likely to have at least one section that is not substantially vertical. FIG. 2 is a schematic view of the prior art wellsite system 10 of FIG. 1, showing the downhole tool string 100 suspended in a non-vertical section 26 of a wellbore 24. As a result, the non-vertical sidewall 28 of the non-vertical section 26 of the wellbore 24 may cause contact and/or friction against the downhole tool string 100 and/or otherwise impede the intended conveyance or movement of the downhole tool string 100 through the wellbore 24. Moreover, impacts, friction, vibrations, and other forces resulting from such contact and/or friction may cause damage to the downhole tool string 100 when conveyed through the substantially non-vertical section 26 of the wellbore 24.

Figure 3:
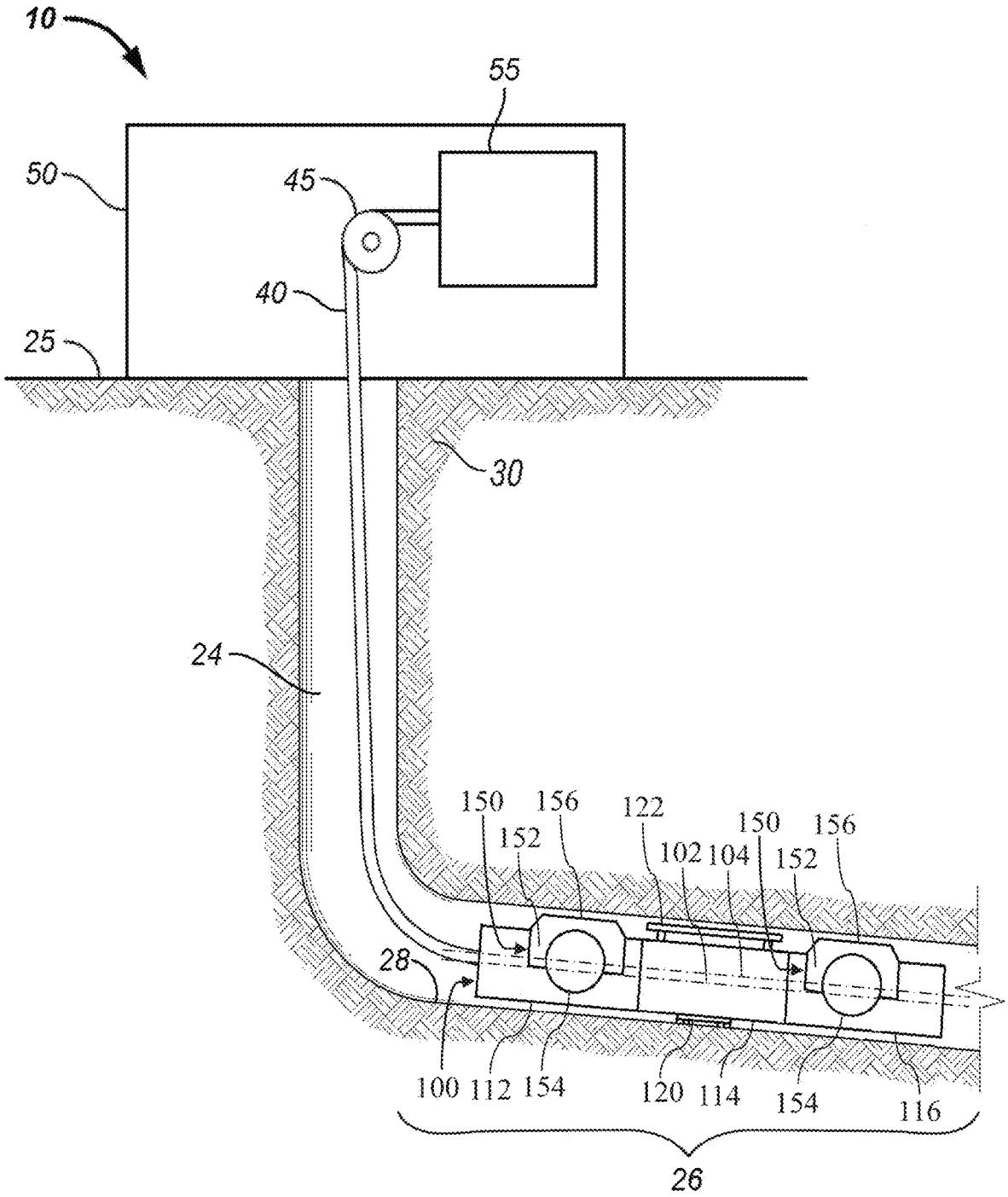
FIG. 3 is a schematic view of at least a portion of apparatus according to one or more aspects of the present disclosure disposed in a substantially non-vertical wellbore.

FIG. 3 is a schematic view of the wellsite system 10 of FIG. 1, showing the downhole tool string 100 suspended in the non-vertical section 26 of the wellbore 24 shown in FIG. 2, but also comprising a tool string orienting apparatus 150 (hereinafter referred to as an "orienting tool") according to one or more aspects of the present disclosure. The orienting tool 150 may be operable to rotate, orient, or aid in orienting the downhole tool string 100 to a selected orientation or rotational position within the non-vertical section 26 of the wellbore 24. The orienting tool 150 may be further operable to translate, convey, or aid in conveying the downhole tool string 100 axially or longitudinally along the non-vertical section 26 of the wellbore 24. Unless described otherwise, the terms orientation, rotational position, and other related terms, as used herein when describing the tool string 100 and orienting tool 150, may refer to rotational or angular direction of the tool string 100 and orienting tool 150 with respect to or about a central axis of the non-vertical portion 26 of the wellbore 24 or another axis extending longitudinally along the non-vertical portion 26 of the wellbore 24. Similarly, unless described otherwise, the term rotation, as used herein when describing the tool string 100 and orienting tool 150, may refer to the angular movement or rotation of the tool string 100 and orienting tool 150 with respect to or about the central axis or another axis extending longitudinally along portion(s) of the wellbore, such as the non-vertical portion 26 of the wellbore 24.

FIG. 3 shows two orienting tools 150 connected with the tool string 100. However, additional orienting tools 150 may be connected with the tool string 100 depending on various factors, such as length, weight, flexibility, and/or other parameters associated with the tool string 100. The tool string 100 may include two, three, four, or more orienting tools 150 connected at various axial positions along the length of the tool string 100. As described below, the orienting tools 150 may be rotationally aligned with each other in a substantially same rotational direction along the tool string 100, such as to facilitate the intended orientation of the whole tool string 100. Although the probe/sensor 120 is shown oriented against the bottom portion of the sidewall 28 of the non-vertical section 26 of the wellbore 24, it is to be understood that the orienting tools 150 may be connected with the tool string 100 such that the probe/sensor 120 is oriented or directed toward an upper portion, a side portion, or another portion of the non-vertical sidewall 28 of the wellbore 24.

The orienting tools 150 may collectively lift or support at least a portion of the tool string 100 at a distance from a bottom portion of the sidewall 28, such as may reduce or prevent contact and/or friction between the tool string 100 and the sidewall 28 while the tool string 100 is conveyed axially along the non-vertical portion 26 of the wellbore 24. The lifting action of the orienting tool 150 may also facilitate an intended offset between a portion of the tool string 100 (e.g., the probe/sensor 120) and the sidewall 28. Such offset may be zero in some implementations, such that the orienting tools 150 may be intended to cooperatively position the portion of the tool string 100 in contact with the bottom portion of the sidewall 28 of the non-vertical portion 26 of the wellbore 24.

Each orienting tool 150 may comprise orienting features 154 (only one shown) rotatably disposed on opposing sides of the tool string 100 for rotation about corresponding axes of rotation, and extending radially outward with respect to the tool string 100. The orienting features 154 may be operable to rotate or otherwise orient the orienting tool 150 and, thus, the tool string 100 connected with the orienting tool 150, toward an intended rotational position within the non-vertical section 26 of the wellbore 24. For example, the axes of rotation of the orienting features 154 may be radially offset from a central axis 102 of the tool string 100 in a manner that urges and/or otherwise results in the tool string 100 tipping over or otherwise reorienting from an unintended to an intended rotational position. In the intended rotational position, as depicted in FIG. 3, the axes of rotation of the orienting features 154 may be disposed above (e.g., opposite the direction of gravity) the central axis 102 of the tool string 100, such that the probe/sensor 120 abuts or faces the lower portion of the non-vertical portion 26 of the wellbore 24. The orienting features 154 may also facilitate axial conveyance of the tool string 100 along the sidewall 28 of the non-vertical section 26 of the wellbore 24, such as in implementations in which the orienting features 154 are or comprise two opposing rollers, including as described below.

Each orienting tool 150 may also comprise another orienting feature 156 located between the opposing orienting features 154 and extending radially outward with respect to the tool string 100. The orienting features 156 may also aid in rotation of the tool string 100 toward the intended rotational position within the non-vertical section 26 of the wellbore 24. For example, a geometric centerline 104 of the assembly of the tool string 100 and the orienting tools 150 can be considered as the line that extends parallel to the central axis 102 of the tool string 100, but offset in a radial direction toward the orienting features 156, such as by an amount equal to the average of the offsets (relative to the central axis 102 of the tool string 100) of the centroids of the cross-sectional shapes at infinite axial locations along the length of the assembly. The radial offset of the geometric centerline 104 from a center of mass of the assembly of the tool string 100 and the orienting tools 150, which may substantially coincide with the central axis 102 of the tool string 100, can create a mechanical instability when the geometric centerline 104 is not located directly above the center of mass of the assembly. The mechanical instability can cause gravity to urge rotation of the assembly toward a mechanically stable condition, such as in which the geometric centerline 104 is located directly above the center of mass of the assembly.

Each orienting tool 150 may also comprise a body, chassis, or other frame 152, which may be operable to clamp, grip, or otherwise connect the orienting tool 150 with an outer wall or surface of the tool string 100 in a manner preventing movement of the frame 152 relative to the tool string 100. The orienting features 154, 156 may also be connected with the frame 152.

Although the tool string 100 and the orienting tools 150 are shown deployed within a wellbore 24 lacking a casing, it is to be understood that the orienting tool 150 described herein may also be deployed or otherwise utilized within a casing or another tubular disposed within the wellbore 24.

Accordingly, the space through which the tool string 100 and the orienting tool 150 are to be conveyed is referred to hereinafter as a "passage."

Figure 4:
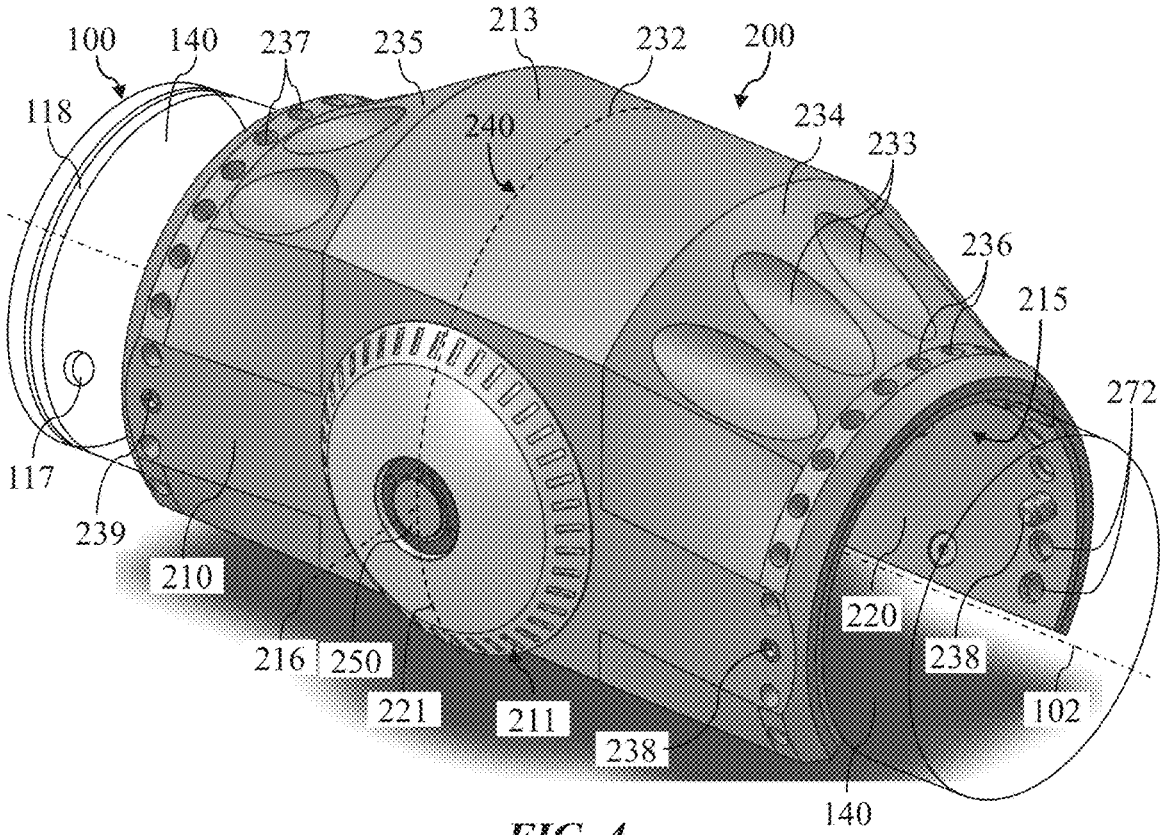
FIG. 4 is a perspective view of a portion of an example implementation of the apparatus shown in FIG. 3 according to one or more aspects of the present disclosure.
Figure 5:
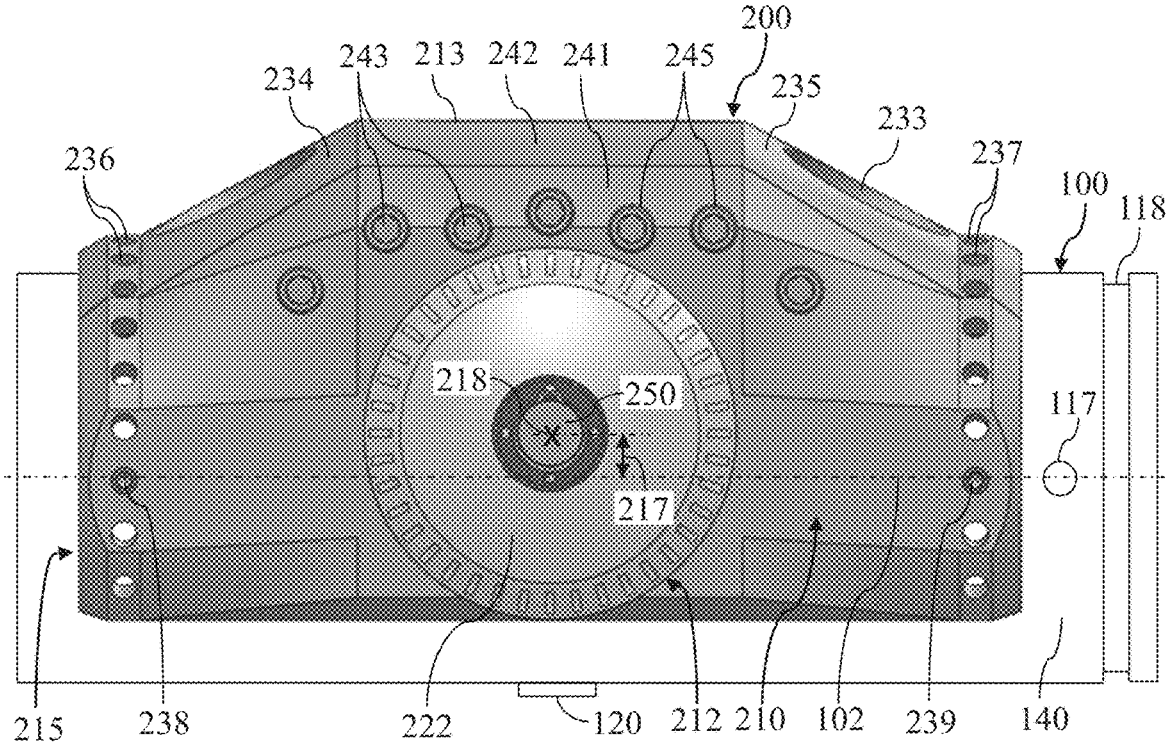
FIG. 5 is a side view of a portion of the apparatus shown in FIG. 4 according to one or more aspects of the present disclosure.
Figure 6:
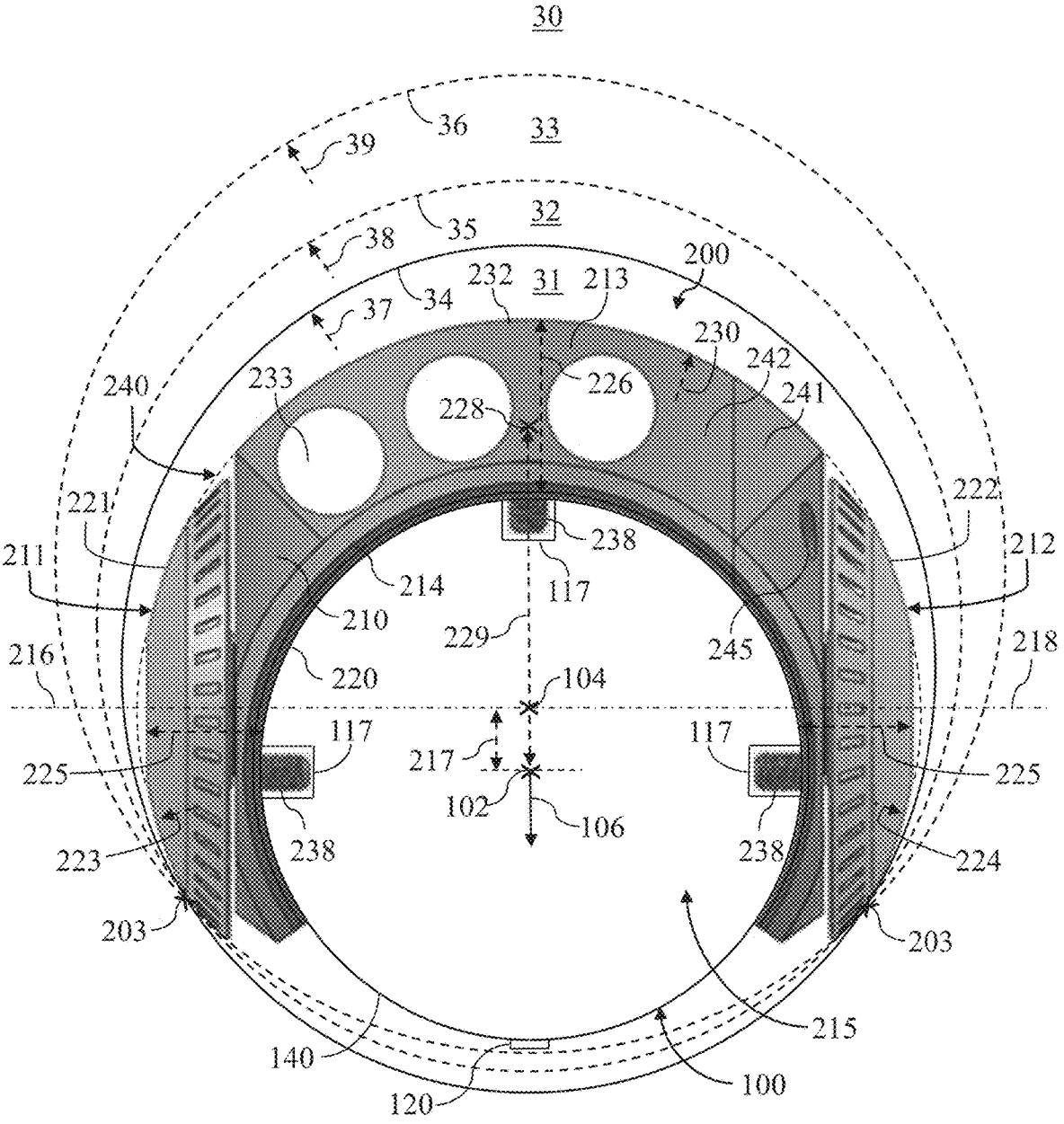
FIG. 6 is an axial view of a portion of the apparatus shown in FIG. 4 according to one or more aspects of the present disclosure.

FIGS. 4, 5, and 6 are perspective, side, and axial views of a portion of an example implementation of the tool string 100 and an orienting tool 200 according to one or more aspects of the present disclosure. FIG. 6 shows the orienting tool 200 disposed within a horizontal or otherwise deviated portion of a subterranean passage 31. The following description refers to FIGS. 4-6, collectively.

Similarly to the orienting tool 150 described above, the orienting tool 200 may be connected with the tool string 100 and operable to orient the tool string 100 within the passage 31. The orienting tool 200 may comprise first and second orienting features 211, 212 rotatably connected on opposing sides of the downhole tool string 100, for example, via a body, chassis, or other frame 210 operable for connection with the tool string 100. The orienting tool 200 may further comprise a third orienting feature 213 extending radially outward with respect to the tool string 100 between the first and second orienting features 211, 212. The third orienting feature 213 may be a standoff, hump, wedge, or other feature, and may be connected with the tool string 100 and/or the first and second orienting features 211, 212 via the frame 210.

The first orienting feature 211 may be rotatably connected with a first side of the frame 210 and rotate relative to the frame 210 about a first axis of rotation 216. Similarly, the second orienting feature 212 may be rotatably connected to a second side of the frame 210 (opposite the first side of the frame 210) and rotate relative to the frame 210 about a second axis of rotation 218. For example, the first and second axes of rotation 216, 218 may be substantially collinear and may be radially offset 217 from a central axis 102 of the tool string 100 by a predetermined distance. The first and second axes of rotation 216, 218 of the orienting features 211, 212 may extend substantially perpendicularly with respect to the central axis 102 of the tool string 100, however, the central axis 102 of the tool string 100 may be located below the axes of rotation 216, 218 when the tool string 100 and the orienting tool 200 are in an intended (i.e., mechanically stable) rotational position within the passage 31, such as shown in FIG. 6. Although the axes of rotation 216, 218 are shown and described as being substantially collinear, it is to be understood that the axes of rotation 216, 218 may not be substantially collinear and extend at an angle with respect to each other. For example, the axes of rotation 216, 218 may intercept at a single point, such as along a vertical plane of symmetry (not shown) of the tool string 100 extending though the central axis 104 and/or the geometric centerline 104.

The first and second orienting features 211, 212 may each be or comprise a roller operable to facilitate rolling along the sidewall 34 and thereby facilitate axial conveyance of the tool string 100 within the passage 31. The orienting features 211, 212 may be operable to support the tool string 100 at an intended offset distance from the sidewall 34. Each of the first and second orienting features 211, 212 may be disk or bowl shaped, comprising curved outer surfaces or profiles 221, 222 (e.g., viewed from a perspective along the central axis 102) each representing a segment of a spheroid having a radius 223, 224 that may be smaller than a radius 37 of a cross-section of the sidewall 34 of the passage 31.

The passage 31 depicted in FIG. 6 is defined by the sidewall 34 (whose cross-section has the radius 37) and extending non-vertically through the subterranean formation 30. However, it is to be understood that the tool string 100 and the orienting tool 200 may be disposed within different sized passages, such as passages 32, 33 defined by sidewalls 35, 36, the cross-sections of each having a corresponding radius 38, 39. A portion of the tool string 100 located at the bottom side of the tool string 100, may be located below points of contact 203 between the first and second orienting features 211, 212 and the sidewall 34, 35, 36 and, thus, in close proximity to the bottom portion of the sidewall 34, 35, 36. When the passage size increases and the radius 37, 38, 39 of the sidewall 34, 35, 36 increases, clearance or spacing between the bottom side of the tool string 100 and the sidewall 34, 35, 36 may progressively decrease, such that the portion of the tool string 100 may be located closer to the bottom portion of the sidewall 34, 35, 36. The portion of the tool string 100 at the bottom side of the tool string 100 may contact the sidewall 34, 35, 36 if the passage 31, 32, 33 is too large for the orienting tool 200. Thus, different sized orienting features 211, 212 may be utilized within different sized passages 31, 32, 33 to maintain a minimum gap between the tool string 100 and the sidewall 34, 35, 36 of the passage 31, 32, 33.

The third orienting feature 213 may be located circumferentially between or interposing the first and second orienting features 211, 212 and extend radially outward with respect to the tool string 100. The third orienting feature 213 and the axes of rotation 216, 218 may be located on the same side of the central axis 102 of the tool string 100. The third orienting feature may have a center of mass 228 that is offset from the central axis 102 of the tool string 100 in a radial direction by a distance 229. The center of mass 228 and the central axis 102 may be on opposing sides of the first and second axes of rotation 216, 218, such that the first and second axes of rotation 216, 218 each interpose the center of mass 228 of the third orienting feature 213 and the central axis 102.

Although the third orienting feature 213 is depicted in FIGS. 4-6 as being integral or integrally formed with the frame 210, the third orienting feature 213 may be a distinct member fixedly connected with the frame 210, such as via screws, bolts, latches, and interference fit, among other examples. Also, instead of being connected together via the frame 210, the third orienting feature 213 and the first and second orienting features 211, 212 may be separate and distinct members, each connected independently with the tool string 100 via corresponding frames 210.

Similarly to the first and second orienting features 211, 212, the third orienting feature 213 may comprise a curved outer surface or profile 232 (e.g., viewed from a perspective along the central axis 102) representing a segment of a spheroid having a radius 230. The radius 230 may be smaller than the radius 37 of the cross-section of the sidewall 34 of the passage 31. The first and second orienting features 211, 212 may each comprise a radial thickness 225 (i.e., distance between an internal surface 214 of the frame 210 and the outer profiles 221, 222), and the third orienting feature 213 may comprise a radial thickness 226 (i.e., distance between the internal surface 214 of the frame 210 and the outer profile 232). Although the radial thicknesses 225 of the first and second orienting features 211, 212 are identified with the same number, the radial thicknesses 225 may or may not be identical. The radial thickness 225 may be appreciably greater than the radial thicknesses 226. The radial thickness 225, 226 may progressively decrease or taper circumferentially around the tool string 100 in directions away from a central portion (e.g., located above the central axis 102) of the third orienting feature 213 toward opposing ends of the frame 210 and the orienting features 211, 212.

The outer profile 232 of the third orienting feature 213 may extend partially around the circumference of the tool string 100, in some cases substantially continuously between the first and second orienting features 211, 212. Accordingly, the profiles 221, 222, 232 of the first, second, and third orienting features 211, 212, 213, respectively, may collectively form a substantially continuous curved outer profile 240 (e.g., viewed from a perspective along the central axis 102) extending partially around the circumference of the tool string 100. In an example implementation, the substantially continuous curved outer profile 240 may not extend around the entire circumference of the tool string 100, however, the substantially continuous curved outer profile 240 may extend around a majority of the circumference of the tool string 100. The substantially continuous curved outer profile 240, as viewed in cross-section from a perspective along the central axis 102, may be substantially circular, elliptical, or oval, having a centroid or geometric centerline 104 that may be radially offset from the central axis 102 of the tool string 100.

The orienting tool 200 (e.g., the frame 210 and/or third orienting feature 213) may further comprise surfaces 234, 235 extending diagonally or otherwise at slanted angles with respect to the central axis 102 of the downhole tool 100. The surfaces 234, 235 may be rounded, sloped, tapered, and/or otherwise shaped with respect to the central axis 102 in a manner that may reduce friction between the orienting tool 200 and the sidewall 34 and/or wellbore fluid while the orienting tool 200 and the tool string 100 are conveyed through the passage 31. The orienting tool 200 may also include a plurality of holes 233 extending through the third orienting feature 213 and/or the frame 210 between the downhole and uphole surfaces 234, 235 and perhaps substantially parallel to the central axis 102. The holes 233 may permit the passage of wellbore fluid while the tool string 100 and the orienting tool 200 are conveyed through the passage 31.

The frame 210 may be operable to engage an outer surface 140 of the tool string 100 in a manner preventing axial and/or rotational movement of the frame 210 and, thus, the first, second, and third orienting features 211, 212, 213 relative to the tool string 100. The outer surface 140 may include one or more external features, such as cavities, grooves, recesses, holes, and depressions (e.g., 117, 118), among other examples. The frame 210 may extend around at least a portion of a circumference of the tool string 100. For example, the frame 210 may extend around a majority of the circumference of the tool string 100, but not around the entire circumference of the tool string 100. The frame 210 may also comprise an inner surface 214 defining a cavity or void 215 operable to receive or capture the tool string 100 therein, such as to help maintain connection between the frame 210 and the tool string 100. The inner surface 214 may extend around at least a portion of the circumference of the tool string 100. For example, the inner surface 214 may extend around a majority of the circumference of the tool string 100, but not around the entire circumference of the tool string 100. The frame 210 may not rotate with respect to the tool string 100, which may permit a predetermined side of the tool string 100 (e.g., comprising the probe/sensor 120) to be oriented toward a predetermined portion of a sidewall 34 of the passage 31.

One or both axial ends of the frame 210 may include sets of holes 236, 237 extending through the frame 210 and configured to receive therethrough corresponding setscrews 238, 239 for contacting the outer surface 140 of the tool string 100. The holes 236, 237 may be distributed circumferentially along the frame 210 and extend radially (i.e., approximately perpendicular to the central axis 102) through the frame 210. The holes 236, 237 may be threaded, such as may permit the setscrews 238, 239 to threadedly engage and advance through the holes 236, 237. The setscrews 238, 239 may be rotated such that the setscrews 238, 239 advance past the inner surface 214 of the frame 210 and engage the outer surface 140 of the tool string 100 to generate friction between the setscrews 238, 239 and the outer surface 140 of the tool string 100. Accordingly, when tightened against the outer surface 140 of the tool string 100, the setscrews 238, 239 may reduce or prevent axial and/or rotational movement of the frame 210 with respect to the tool string 100 and, thus, maintain the orienting tool 200 in an intended rotational and axial position with respect to the tool string 100.

Prior to engaging the setscrews 238, 239 against the outer surface 140 of the tool string 100, the orienting tool 200 may be rotated (i.e., oriented) about the tool string 100 until an intended relative orientation is achieved. The orienting tool 200 may also be moved axially about the outer surface 140 of the tool string 100 until one or more of the holes 236, 237 and the corresponding setscrews 238, 239 are aligned with one or more cavities, recesses, or holes 117 (such as for receiving a spanner wrench) located along the outer surface 140 of the tool string 100. Thereafter, the one or more aligned setscrews 238, 239 may be rotated such that the setscrews 238, 239 advance into the corresponding holes 117, perhaps until engaging the bottom end of the holes 117. The holes 117 may help maintain the corresponding setscrews 238, 239 in position along the outer surface 140 of the tool string 100 and, thus, provide additional resistance against relative rotational and/or axial movement between the orienting tool 200 and the tool string 100. Because axial distance between the opposing sets of holes 236, 237 may be fixed, just one set (or perhaps not all sets) of holes 236, 237 may be axially aligned with the holes 117. Although FIGS. 4-6 show three setscrews 238, 239 disposed in association with each set of holes 236, 237, additional or fewer setscrews 238, 239 may be utilized to engage the outer surface 140 of the tool string 100 to further help reduce or prevent axial and/or rotational movement of the orienting tool 200 with respect to the tool string 100. Furthermore, instead of or in addition to engaging the setscrews 238, 239 within the holes 117, the setscrews 238, 239 may be engaged within or latch against a make-up groove 118, such as may be located between adjacent first, second, and/or third portions 112, 114, 116 (shown in FIGS. 1-3) of the tool string 100 and/or other grooves, recesses, depressions, or features located along the outer surface 140 of the tool string 100.

Figure 7:
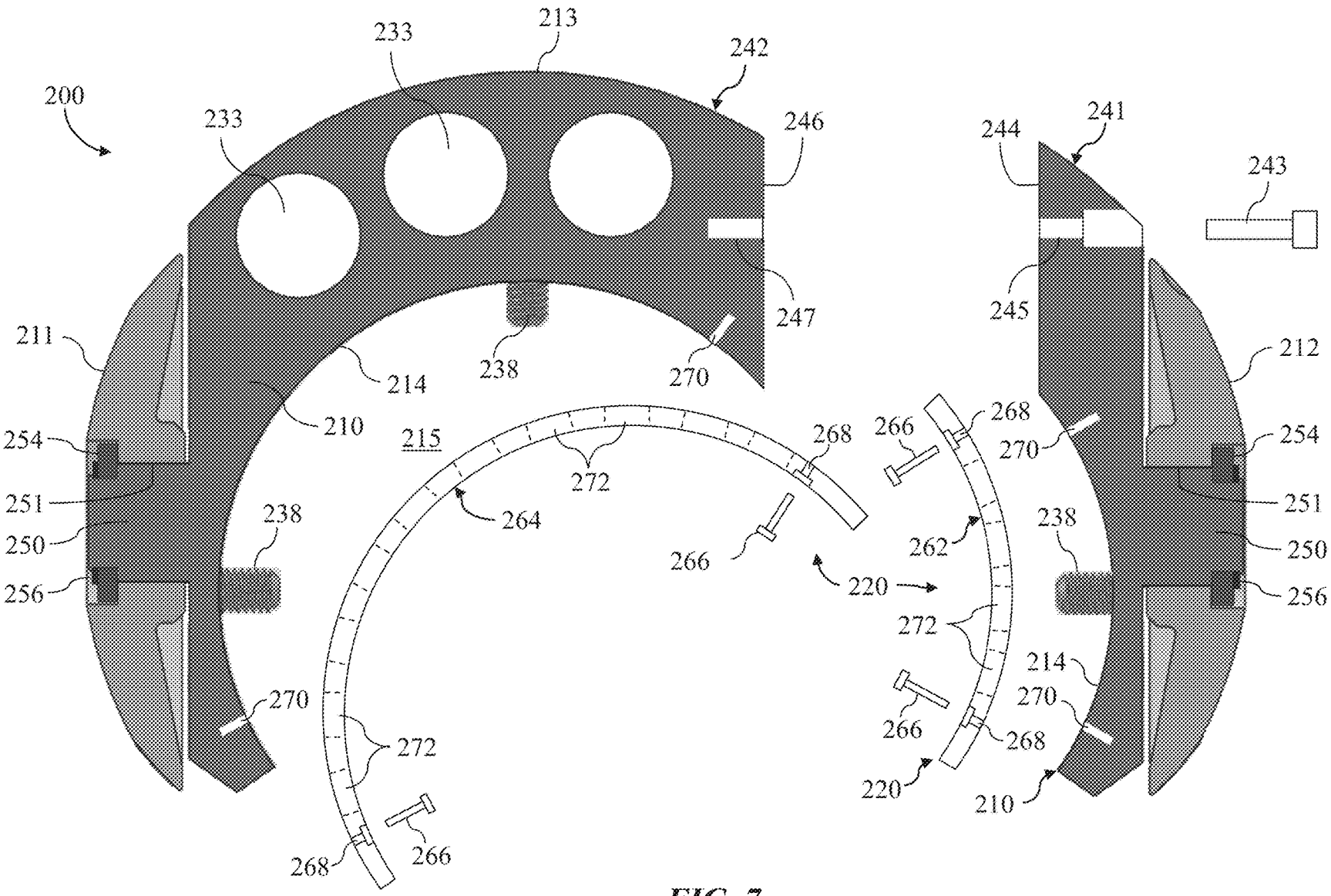
FIG. 7 is an exploded sectional view of a portion of the apparatus shown in FIG. 4 according to one or more aspects of the present disclosure.

FIG. 7 is an exploded sectional view of the orienting tool 200 shown in FIGS. 4, 5, and 6 according to one or more aspects of the present disclosure. The following description refers to FIGS. 4-7, collectively.

Each of the first and second orienting features 211, 212 may be rotatably connected with the frame 210 via corresponding axles 250. The axles 250 may extend between the orienting features 211, 212 and the frame 210. For example, the axles 250 may be integral or integrally formed with the frame 210, or the axles 250 may be fixedly coupled with the frame 210, such as via threads, keys, gears, splines, snap rings, screws, bolts, interference fit, or other coupling means. The orienting features 211, 212 may comprise axial openings or bores 251, such as may permit the orienting features 211, 212 to be rotatably disposed about the axles 250. The orienting features 211, 212 may be maintained in a predetermined position about the axles 250 via corresponding retaining rings 254, which may threadedly engage the axles 250. The retaining rings 254 may be locked in the predetermined position via corresponding retaining clips 256 fixedly connected with the axles 250. A friction reducing lubricant may be applied between the orienting features 211, 212 and the axles 250 and/or between the orienting features 211, 212 and the frame 210. Although not shown, the orienting tool 200 may further comprise friction reducing bushings disposed between the orienting features 211, 212 and the axles 250 and/or between the orienting features 211, 212 and the frame 210.

The frame 210 may be or comprise a frame assembly comprising two or more frame portions operable to be detachably connected with each other to form the frame 210. The frame 210 may comprise multiple frame portions, such as to facilitate mounting of the orienting tool 200 around the tool string 100. As further shown in FIGS. 4-7, the frame 210 may comprise complimentary frame portions 241, 242 configured to be detachably connected to each other via one or more fasteners, such as bolts 243. The frame portions 241, 242 may be disposed on opposing sides of the tool string 100 such that the inner surfaces 214 of the frame portions 241, 242 may collectively extend around the tool string 100. The orienting feature 212 may be rotatably connected with the frame portion 241 and the orienting feature 211 may be connected with the frame portion 242. The frame portion 241 may comprise a mounting surface 244 and one or a plurality of openings 245 (e.g., bolt holes) extending substantially laterally into the mounting surface 244. The frame portion 242 may comprise a mounting surface 246 and one or a plurality of threaded openings 247 extending substantially laterally into the mounting surface 246. The bolt(s) 243 may be inserted through the opening(s) 245 and threadedly engaged with the threaded opening(s) 247 to connect the frame portions 241, 242 together around the tool string 100 and, thus, connect the orienting tool 200 to the tool string 100. When intended relative orientation and/or axial position between the orienting tool 200 and the tool string 100 is achieved, the bolt(s) 243 may be tightened to clamp the orienting tool 200 around the tool string 100. One or more setscrews 238, 239 may also be advanced into the corresponding holes 117, make-up groves 118, or otherwise against the surface 140 of the tool string 100, as described above. Although the frame portions 241, 242 are shown as being connectable via one or a plurality of bolts 243, the frame portions 241, 242 may be detachably connected together about the tool string 100 via other means, such as interlocking fasteners, retaining pins, and press/interference fit, among other examples.

A spacer 220 may be disposed between the inner surface 214 of the frame 210 and the tool string 100. For example, when the tool string 100 is appreciably smaller than the void 215 defined by the inner surface 214 of the frame 210, a gap or space may be created between the inner surface 214 and the tool string 100, such as may prevent or inhibit the inner surface 214 from tightly or otherwise closely fitting about the tool string 100. The spacer 220 may thus permit the orienting tool 200 to be clamped about the tool string 100. The spacer 220 may provide friction and/or clamping force against the tool string 100, such as to help prevent the relative motion between the orienting tool 200 and the tool string 100. Utilizing different sized spacers 220, such as comprising different radial thicknesses and/or different diameters, may permit one orienting tool 200 to be connected to downhole tools and/or tool strings 100 having different outer diameters. The spacer 220 may be or comprise at least a portion of a sleeve or a sleeve segment extending at least partially around the tool string 100 between the tool string 100 and the frame 210.

Similarly to the frame 110, the spacer 220 may be provided in two or more portions. For example, the spacer 220 may comprise a spacer segment 262 configured to be disposed between the frame portion 241 and the tool string 100, and a spacer segment 264 configured to be disposed between the frame portion 242 and the tool string 100. Each spacer segment 262, 264 may be maintained in position at least partially touching the surface 214 of the corresponding frame portion 241, 242 via a plurality of bolts 266 or other fasteners. The bolts 266 may extend through corresponding holes 268 in the spacer segments 262, 264 and threadedly engage corresponding threaded holes 270 extending at least partially into the surfaces 214 of the frame portions 241, 242 to fixedly maintain the spacer segments 262, 264 against the surfaces 214 of the frame portions 241, 242. The spacer segments 262, 264 may further comprise a plurality of holes 272 configured to align with at least some of the holes 236, 237 and to accommodate the setscrews 238, 239 extending therethrough to the outer surface 140 of the tool string 100.

The orienting tool 200 may be coupled with the tool string 100 such that certain features of the tool string 100, such as the probe/sensor 120, may be aligned toward an intended portion of the sidewall 34 of the passage 31. For example, one or more orienting tools 200 may be oriented with respect to the tool string 100 to cause the probe/sensor 120 to be oriented in a substantially downward direction (i.e., in the direction of gravity) toward or against the bottom portion of the sidewall 34. In such implementations, the orienting tools 200 may be connected to the tool string 100 such that the probe/sensor 120 may be disposed circumferentially between the first and second orienting features 211, 212, and the central axis 102 of the tool string 100 may be located radially between the probe/sensor 120 and the axes of rotation 216, 218. As shown in FIGS. 3, 5, and 6, the orienting tools 200 may be positioned relative to the tool string 100 such that the probe/sensor 120 is angularly positioned at approximately six o'clock (e.g., substantially downward, in the direction of gravity).

However, in other implementations within the scope of the present disclosure, one or more orienting tools 200 may orient the probe/sensor 120 and/or other portions of the tool string 100 at other predetermined angular positions. For example, one or more of the orienting tools 200 may be positioned relative to the tool string 100 such that the probe/sensor 120 is positioned at twelve o'clock (substantially upward, opposite the direction of gravity), three o'clock (from left-to-right relative to the page in FIG. 6), nine o'clock (from right-to-left relative to the page in FIG. 6), and angularly between these positions. When multiple orienting tools 200 are utilized along the tool string 100, each of the orienting tools 200 or a portion of the orienting tool 200 may be rotatably oriented as intended with respect to each other. For example, each orienting tool 200 may be oriented about the tool string 100 such that each of the third orienting features 213 extends in the same radial direction. Thus, when the probe/sensor 120 is oriented toward an upper portion (i.e., top side) of the sidewall 34, the probe/sensor 120 may avoid contacting debris that may have settled along the bottom portion of the passage 31 and the third orienting feature 213 may prevent or reduce contact between the probe/sensor 120 and the sidewall 34 during conveyance.

When the orienting tool 200 is coupled with the tool string 100, the substantially continuous curved outer profile 240 collectively formed by the orienting features 211, 212, 213 may circumferentially extend around a majority of a portion of the tool string 100. Thus, the geometric centerline 104 of the cross-section of the substantially continuous curved outer profile 240 may also approximate or become a geometric center, but not a center of mass, of an assembly comprising the tool string 100 and the orienting tool 200. The weight of the tool string 100 may be much (e.g., several times) greater than the weight of the orienting tool 200 and may be represented by a downward gravitational force 106 applied at a center of gravity (i.e., center of mass) of the tool string 100, which may substantially coincide with the central axis 102. In some cases, the geometric centerline 104 may coincide with the axes of rotation 216, 218 and, thus, may be radially offset 217 from the central axis 102 of the tool string 100.

Because the mass of the tool string 100 is much greater than the collective mass of the orienting tools 200, the radial offsets 217 between the central axis 102 and the geometric centerline 104 create a mechanical instability of the assembly of the tool string 100 and the orienting tools 200 when the center of mass of the tool string 100 and, thus, the central axis 102 is not located directly below the geometric centerline 104. Such mechanical instability can result in the gravitational force 106 (i.e., weight of the tool string 100) causing a torque about the geometric centerline 104 that urges rotation of the assembly toward a mechanically stable orientation in which the central axis 102 of the tool string 100 may be located directly below the geometric centerline 104. The torque and, thus, the tendency of the assembly of the tool string 100 and orienting tools 200 to rotate, may be directly proportional to the distance of the radial offsets 217 between the geometric centerline 104 and the central axis 102.

Accordingly, when the assembly of the tool string 100 and orienting tools 200 is oriented in its most stable (i.e., intended) position within the passage 31, as shown in FIG. 6, the central axis 102 may be located directly below geometric centerline 104 at its lowermost position (i.e., closest to the bottom portion of the sidewall 34), and the axes of rotation 216, 218 may extend (substantially horizontally) above the central axis 102. However, during downhole conveyance, when the assembly of the tool string 100 and orienting tools 200 is not oriented in a mechanically stable position within the passage 31, the gravitational force 106 applied at the central axis 102 may cause a torque about the geometric centerline 104 urging rotation of the assembly of the tool string 100 and orienting tools 200 toward the mechanically stable position. The operational aspects of urging the assembly of the tool string 100 and orienting tools 200 to rotate are further explained below.

Figure 8:
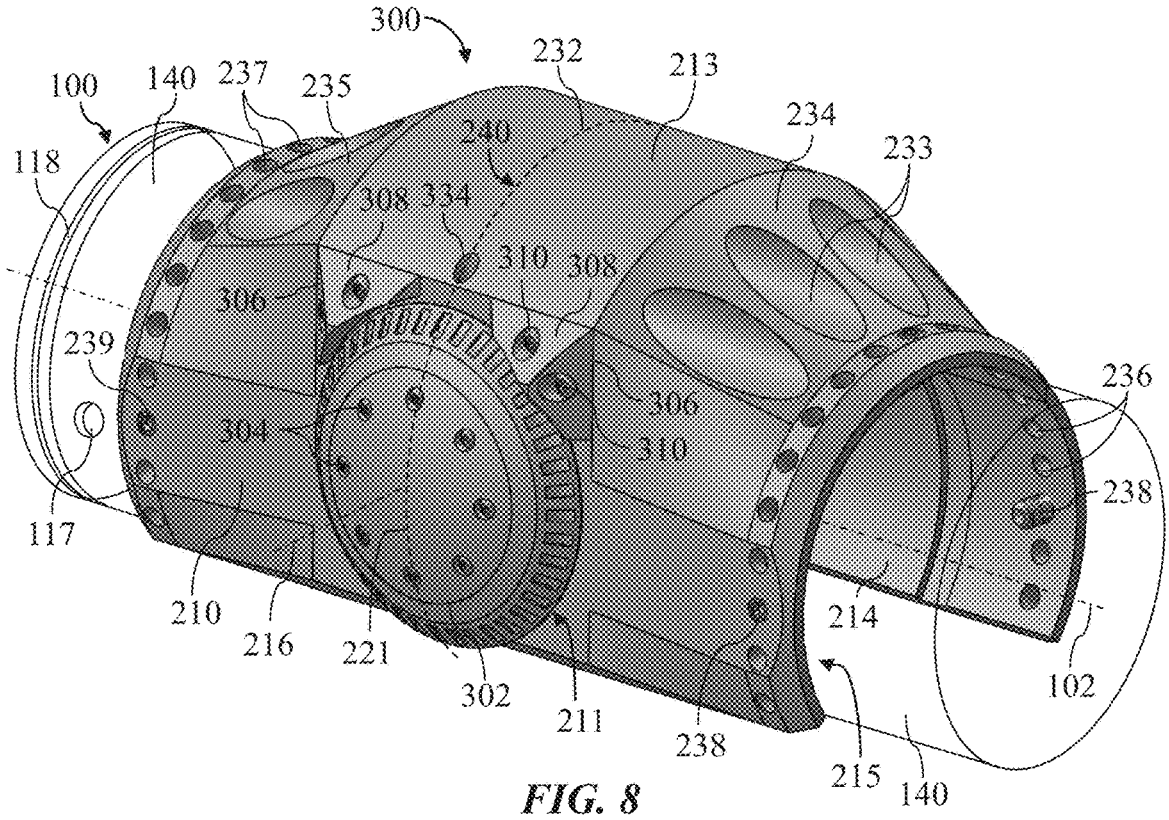
FIG. 8 is a perspective view of a portion of another example implementation of the apparatus shown in FIG. 3 according to one or more aspects of the present disclosure.
Figure 9:
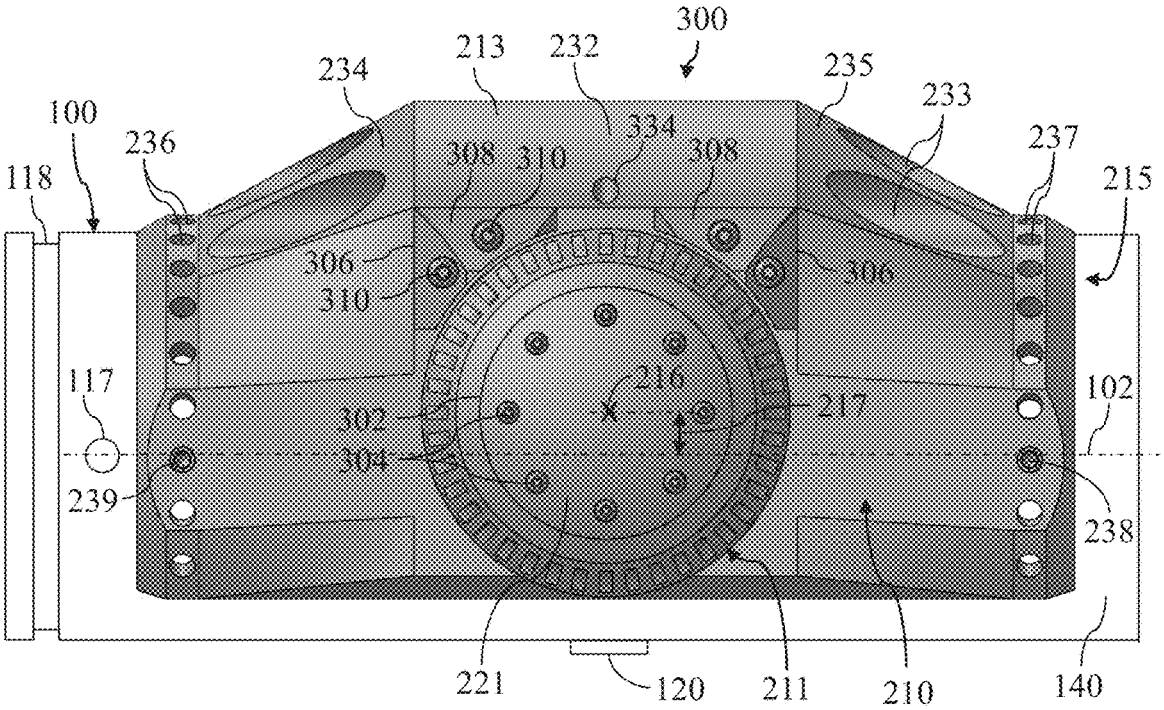
FIG. 9 is a side view of a portion of the apparatus shown in FIG. 8 according to one or more aspects of the present disclosure.
Figure 10:
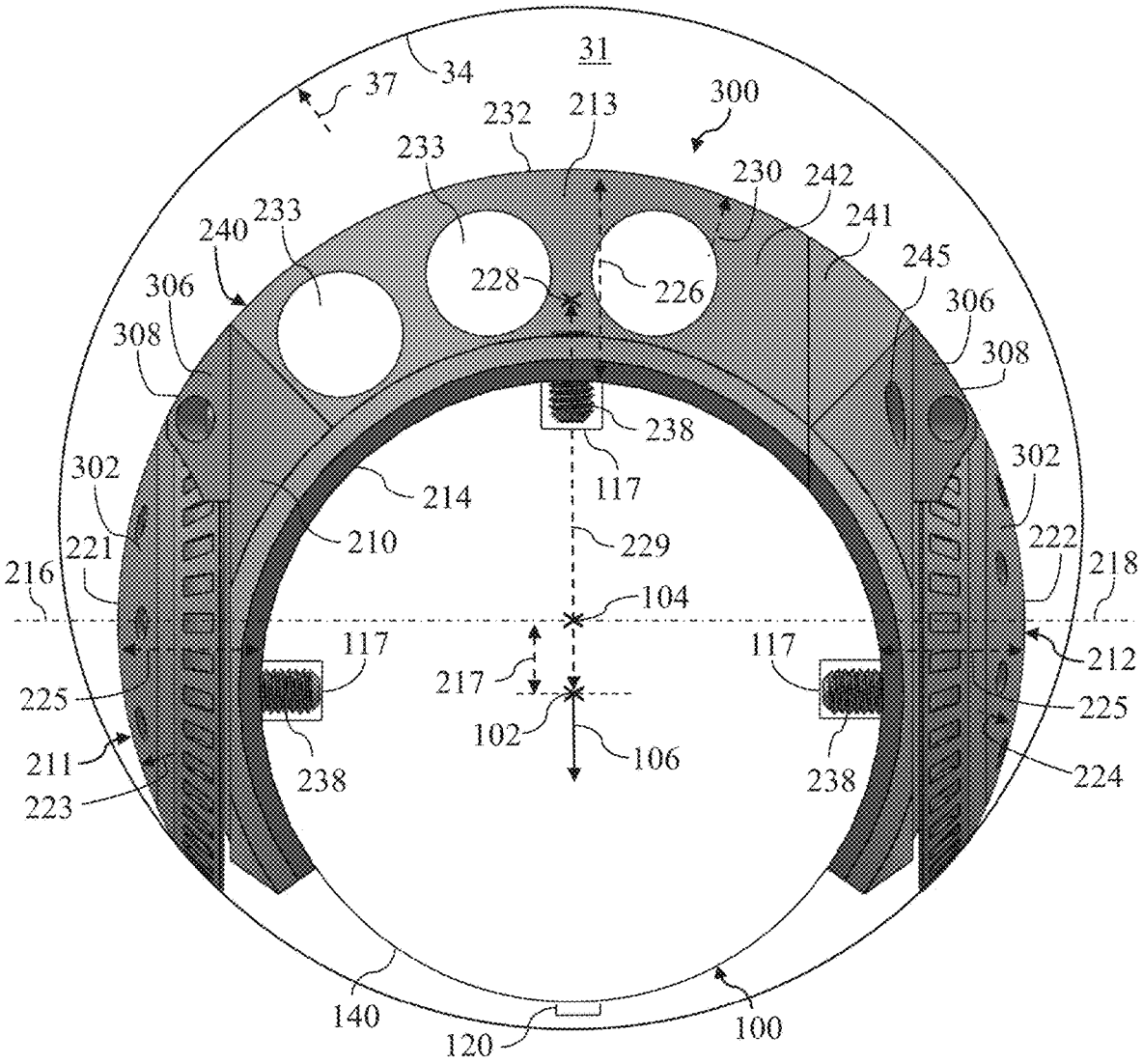
FIG. 10 is an axial view of a portion of the apparatus shown in FIG. 8 according to one or more aspects of the present disclosure.

FIGS. 8, 9, and 10 are perspective, side, and axial views of a portion of an example implementation of the tool string 100 and an orienting tool 300 according to one or more aspects of the present disclosure. FIG. 10 shows the orienting tool 300 disposed within a horizontal or otherwise deviated portion of a subterranean passage 31. The orienting tool 300 may comprise one or more features of the orienting tool 200 described above, including where indicated by like reference numbers, except as described below. The following description refers to FIGS. 8-10, collectively.

Similarly to the orienting tools 150, 200 described above, the orienting tool 300 may be connected with the tool string 100 and operable to orient the tool string 100 within the passage 31. The orienting tool 300 may comprise first and second orienting features 211, 212 rotatably connected at circumferentially different points of the downhole tool string 100, for example, via a body, a chassis, or a frame 210 operable to detachably connect with the tool string 100. The frame 210 may be operable to engage an outer surface 140 of the tool string 100 to connect the orienting tool 300 to the tool string 100 in a manner preventing, restricting, or inhibiting movement of the frame 210 and, thus, the orienting tool 300 relative to the tool string 100. The frame 210 may have an inner surface 214 defining a cavity or void 215 configured to receive or capture the tool string 100 therein, such as to help maintain connection between the frame 210 and the tool string 100. A spacer 220 (shown in FIGS. 4, 6, and 7) may be disposed between the frame 210 and the tool string 100.

The first and second orienting features 211, 212 may each be or comprise a roller operable roll along the sidewall 34 of the passage 31 and, thereby, facilitate axial conveyance of the tool string 100 within the passage 31. The first orienting feature 211 may be rotatably connected with a first side of the frame 210 and rotate relative to the frame 210 about a first axis of rotation 216. Similarly, the second orienting feature 212 may be rotatably connected to a second side of the frame 210 (e.g., opposite the first side of the frame 210) and rotate relative to the frame 210 about a second axis of rotation 218. Each of the first and second orienting features 211, 212 may be disk or bowl shaped, comprising a convex or otherwise outwardly curved outer surface or profile 221, 222 and representing a segment of a spheroid having a radius 223, 224 that may be smaller than a radius 37 of a cross-section of the sidewall 34 of the passage 31.

The orienting tool 300 may further comprise a third orienting feature 213 extending radially outward with respect to the tool string 100 circumferentially between or interposing the first and second orienting features 211, 212. Similarly to the first and second orienting features 211, 212, the third orienting feature 213 may comprise a curved outer surface or profile 232 (e.g., viewed from a perspective along the central axis 102) representing a segment of a spheroid having a radius 230. The outer profile 232 of the third orienting feature may extend partially around the circumference of the tool string 100, in some cases substantially continuously between the first and second orienting features 211, 212. Accordingly, the profiles 221, 222, 232 of the first, second, and third orienting features 211, 212, 213 collectively form a substantially continuous curved outer profile 240 (e.g., viewed from a perspective along the central axis 102) extending partially around the circumference of the tool string 100.

The third orienting feature 213 may overlap with or extend past (along the axes of rotation 216, 218) a portion of the first and second orienting features 211, 212 such that a portion of the profile 232 overlaps or extends past a portion of the profiles 221, 222. For example, the third orienting feature 213 may comprise one or more extended portions or protrusions 306, each comprising a curved outer surface or profile 308 that can form a portion of or can be substantially continuous with the profile 232 of the third orienting feature 213. The protrusions 306 may overlap with or extend past (along the axes of rotation 216, 218) at least a portion of the first and second orienting features 211, 212. The profiles 308 of the protrusions 306 may reduce or eliminate gaps, cavities, depressions, recesses, or other transition areas that may be formed between the third orienting feature 213 and the first and second orienting features 211, 212 that may break or disrupt the substantially continuous curved outer profile 240. Accordingly, as shown in FIG. 10, the protrusions 306 may maintain a substantially seamless transition between the profiles 221, 222, 232 of the orienting features 211, 212, 213 and, thus, partially form or maintain the substantially continuous curved outer profile 240 of the orienting tool 300.

The protrusions 306 may be implemented as corner blocks extending laterally (e.g., along the axes of rotation 216, 218) from the third orienting feature 213 or the frame 210 past at least a portion of each of the orienting features 211, 212.

The protrusions 306 may be located circumferentially between at least a portion of each first and second orienting feature 211, 212 and the third orienting feature 213 (e.g., when viewed from a perspective along the central axis 102), and/or between at least a portion of each first and second orienting feature 211, 212 and the third orienting feature 213 (e.g., when viewed from a perspective along the axes of rotation 216, 218). The protrusions 306 may be separate and distinct members that are detachably connected with the third orienting feature 213 or with the frame 210. For example, the protrusions 306 may be maintained in position by a plurality of threaded bolts 310 extending through the protrusions 306 and threadedly engaging the third orienting feature 213 and/or the frame 210. However, the protrusions 306 may be integral to or integrally formed with the third orienting feature 213 and/or the frame 210. For example, the protrusions 306 and the third orienting feature 213 and/or the frame 210 may be machined or cut from a single piece of material.

Figure 11:
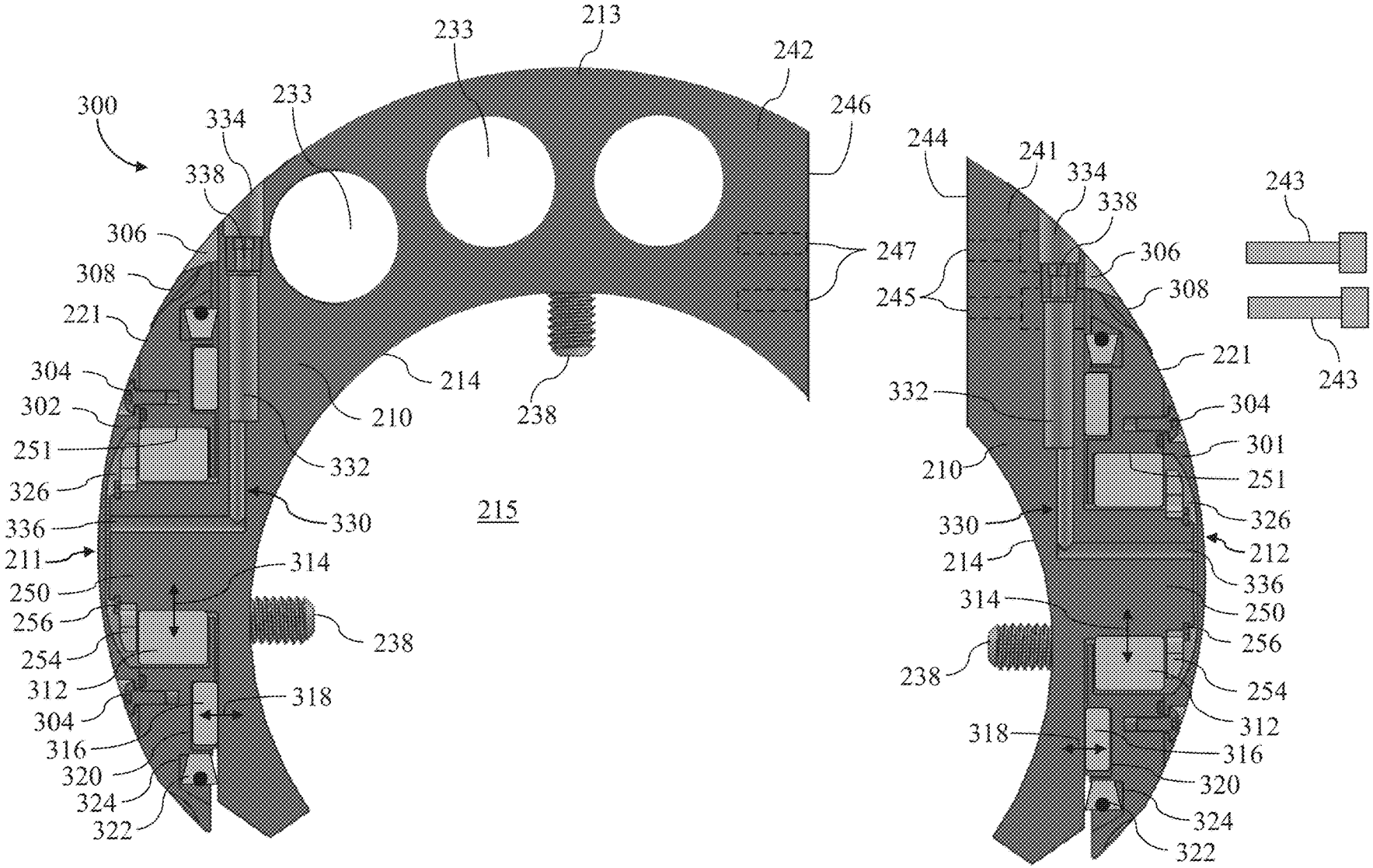
FIG. 11 is an exploded sectional view of a portion of the apparatus shown in FIG. 8 according to one or more aspects of the present disclosure.

FIG. 11 is a partial exploded sectional view of the orienting tool 300 shown in FIGS. 8-10 according to one or more aspects of the present disclosure. The following description refers to FIGS. 8-11, collectively.

Each of the first and second orienting features 211, 212 may be rotatably connected with the frame 210 via corresponding axles 250 extending between the orienting features 211, 212 and the frame 210. The axles 250 may be integral or integrally formed with the frame 210 or the axles 250 may be fixedly coupled with the frame 210, such as via threads, keys, gears, splines, snap rings, screws, bolts, interference fit, or other coupling means. The orienting features 211, 212 may comprise axial openings or bores 251, such as may permit the orienting features to be rotatably disposed about the axles 250. The orienting features 211, 212 may be maintained in a predetermined position about the axles 250 via corresponding retaining rings 254, which may threadedly engage the axles 250. The retaining rings 254 and, thus, the orienting features 211, 212 may be locked in the predetermined position via corresponding retaining clips 256 fixedly connected with the axles 250.

The orienting features 211, 212 may comprise one or more friction reducing members configured to facilitate low-friction rotation of the first and second orienting features 211, 212 about the corresponding axles 250 and to distribute loads imparted to the orienting features 211, 212. The orienting features 211, 212 may comprise radial friction reducing members 312 disposed about the axles 250 and operable to support radial loads 314 applied to the orienting features 211, 212, such as the weight of the orienting tool 300 and the tool string 100. The orienting features 211, 212 may further comprise axial friction reducing members 316 disposed against the frame 210 and operable to support axial loads 318 applied to the orienting features 211, 212, such as caused by the curved sidewalls 34 of the passage 31 and/or when the assembly of the orienting tool 300 and the tool string 100 is not in a mechanically stable position (e.g., on its side). Each friction reducing member 316 may be disposed within a cavity 320 extending along an inner surface of a corresponding orienting feature 211, 212 and around a corresponding axle 250. The friction reducing members 312 may be implemented as roller radial bearings, tapered roller bearings, friction reducing bushings, and lubricant bearings, among other examples, and the friction reducing members 316 may be implemented as roller thrust bearings, friction reducing thrust bushings, tapered roller bearings, ball bearings, and lubricant bearings, among other examples.

The outer profile 221, 222 of each orienting feature 211, 212 may be at least partially defined by a corresponding end cap 302 (i.e., a center cover), each configured for mounting or connecting to a corresponding orienting feature 211, 212. Each end cap 302 may be disk or bowl shaped, comprising a convex outer surface or profile. The end caps 302 may be connected at axial centers (i.e., along the axes of rotation 216, 218) of the orienting features 211, 212 and configured to cover central openings 251 (i.e., axial bores) extending through the orienting features 211, 212. Accordingly, the end caps 302 and the orienting features 211, 212 may collectively form substantially seamless outer profiles 221, 222. The end caps 302 may be connected with the orienting features 211, 212 by one or more retaining members. For example, the end caps 302 may be maintained in position by a plurality of threaded bolts 304 extending through the end caps 302, around an outer perimeter of the end caps 302, and threadedly engaging the orienting features 211, 212.

The end caps 302 may cover the axles 250, the friction reducing members 312, 316, the retaining rings 254, and the retaining clips 256 (collective referred to as "internal components") extending through or otherwise disposed within the axial openings 251 of the orienting features 211, 212. The end caps 302 may fluidly isolate the axial openings 251 and the internal components of the orienting features 211, 212 from the space external to the orienting tool 300. Furthermore, a fluid seal 322 (e.g., an O-ring, a lip seal, a cup seal, or the like) may be disposed between and sealingly engage a corresponding one of the first and second orienting features 211, 212 and the frame 210. Each fluid seal 322 may be disposed within an annular cavity 324 extending along the inner surface of the orienting feature 211, 212 around (i.e., radially outward from) the annular cavity 320 containing the friction reducing member 316. Thus, the fluid seals 322 may fluidly isolate the friction reducing members 316 and the other internal components of the orienting features 211, 212 from the space external to the orienting tool 300. Accordingly, each end cap 302 and fluid seal 322 may collectively form or define a corresponding internal chamber or space 326 that is fluidly isolated from the space external to the orienting tool 300, reducing or preventing contaminants carried by the wellbore fluid from contacting the internal components of the orienting features 211, 212.

The orienting tool 300 may further comprise lubrication systems 330, each in association with a corresponding orienting feature 211, 212 and configured to maintain the friction reducing members 312, 316 lubricated. Each lubrication system 330 may comprise a passage 332 extending between the space external to the orienting tool 300 and the internal space 326. The passages 332 may extend through one or more of the third orienting feature 213, the frame 210, and the axles 250. Each passage 332 may extend between an opening 334 in one of the third orienting feature 213 and the frame 210 and an opening 336 in the axle 250. Each passage 332 may contain an inlet or feed port 338 adjacent the opening 334, which may be configured to receive or fluidly connect with a source of lubricant (not shown), such as a grease gun. Each feed port 338 may be configured to maintain the lubricant within a corresponding passage 332. A lubricant (e.g., lubricating grease, gear lubricant) may be injected into each internal space 326 via the feed port 338 until the lubricant at least partially fills the passage 332 and the internal space 326 and, thus, comes into contact with the friction reducing members 312, 316. Each internal space 326 may be at least partially filled with the lubricant, for example, when the lubricant is forced out of the internal space 326 past the fluid seals 322 into the external space. At least a portion of each passage 332 may function as a lubricant reservoir configured to contain a sufficient amount of the lubricant to control friction via the friction reducing members 312, 316 during downhole conveyance and other downhole operations. The lubrication systems 330 may be pressure compensated, whereby the lubricant stored inside the passages 332 may be forced (via pressure differential) into the corresponding spaces 326 when the wellbore pressure increases while the orienting tool 300 is conveyed downhole. Although not shown, each passage 332 may contain a floating piston, such as may fluidly isolate the lubricant within the passage 332 from the external space and/or maintain the lubricant within the passage 332.

The frame 210 may be or comprise a frame assembly comprising two or more frame portions operable to be detachably connected with each other to form the frame 210. The frame 210 may comprise multiple frame portions, for example, to facilitate mounting of the orienting tool 300 around the tool string 100. As shown in FIGS. 10 and 11, the frame 210 may comprise complimentary frame portions 241, 242 configured to be detachably connected to each other via one or more fasteners, such as bolts 243. The frame portions 241, 242 may be disposed on opposing sides of the tool string 100 such that the inner surfaces 214 of the frame portions 241, 242 may collectively extend around the tool string 100. The frame portion 241 may comprise a mounting surface 244 and one or a plurality of openings 245 (e.g., bolt holes) extending substantially laterally into the mounting surface 244 and through the frame portion 241. The frame portion 242 may comprise a mounting surface 246 and one or a plurality of threaded openings 247 extending substantially laterally into the mounting surface 246. The bolt(s) 243 may be inserted through the opening(s) 245 and threadedly engaged with the threaded opening(s) 247 to connect the frame portions 241, 242 together around the tool string 100 and, thus, connect the orienting tool 300 to the tool string 100.

The orienting tool 300 may be coupled with the tool string 100 such that certain features of the tool string 100, such as the probe/sensor 120, may be aligned against an intended portion of the sidewall 34 of the passage 31. When the orienting tool 300 is coupled with the tool string 100, the substantially continuous curved outer profile 240 collectively formed by the orienting features 211, 212, 213 may circumferentially extend around a majority of a portion of the tool string 100. Thus, the geometric centerline 104 of the cross-section of the substantially continuous curved outer profile 240 also becomes a geometric center, but not a center of mass, of an assembly comprising the tool string 100 and the orienting tool 300. Because the mass of the tool string 100 is typically much greater than the mass of the orienting tools 300, a radial offset 217 between the central axis 102 and the geometric centerline 104 can create a mechanical instability of the assembly of the tool string 100 and the orienting tools 300 when the center of mass of the tool string 100 and, thus, the central axis 102 is not located directly below the geometric centerline 104 of the cross-section of the substantially continuous curved outer profile 240. The mechanical instability can cause the gravitational force 106 (i.e., weight of the tool string 100) to create a torque about the geometric centerline 104, urging rotation of the assembly toward a mechanically stable orientation in which the central axis 102 of the tool string 100 may be located directly below the geometric centerline 104. The operational aspects of urging the assembly of the tool string 100 and orienting tools 300 to rotate are further explained below.

FIGS. 12-15 are axial views of a portion of an example implementation of the tool string 100 and an orienting tool 500 during different stages of operation. The orienting tool 500 may be or comprise an instance of the orienting tools 150, 200, 300 described above. FIGS. 12-15 show the orienting tool 500 connected with the tool string 100 and disposed within a non-vertical portion of a subterranean passage 31 defined by a side surface 35 whose cross-section has a radius 37.

Figure 12:
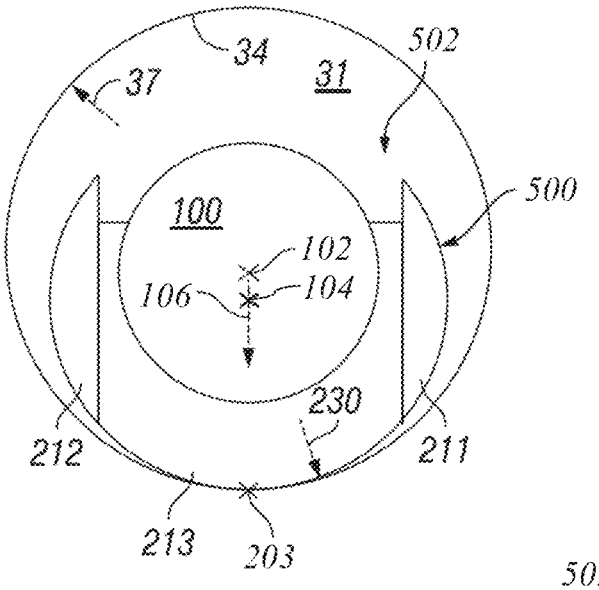
FIGS. 12-15 are schematic axial views of the apparatus shown in FIG. 3 during different stages of operation according to one or more aspects of the present disclosure.

FIG. 12 shows the orienting tool 500 disposed within the passage 31 in a fully inverted position, in which the third orienting feature 213 is extending in the downward direction and is in contact with a bottom portion of the sidewall 34 along a contact point 203. The weight of the tool string 100 is supported above the sidewall 34 by the orienting tool 500, and approximated by a downward force 106 applied along the center of gravity of the tool string 100, which substantially coincides with a central axis 102 of the tool string 100. Although the center of gravity of the tool string 100 and, thus, the downward force 106, is shown located directly above (perpendicular to) the geometric centerline 104 of the orienting tool 500 and contact point 203, the orienting tool 500 and tool string 100 (collectively referred to hereinafter as a downhole assembly 502) is not balanced or otherwise mechanically stable in such orientation. That is, the center of gravity of the tool string 100 is at a high position, causing the downhole assembly 502 to be top heavy and, thus, not balanced or mechanically stable. Also, a radius 230 of a cross-section of the curved outer profile 232 of the third orienting feature 213 is smaller than the radius 37 of the cross-section of the sidewall 34 and, thus, unable to support or prop the downhole assembly 502 in such orientation. Accordingly, during conveying operations, if the downhole assembly 502 is introduced into or being conveyed along the passage 31 while oriented as shown in FIG. 12, the third orienting feature 213 can urge rotation of the downhole assembly 502 away from such unstable orientation and, thus, can cause the downhole assembly 502 to rotate, such as toward an orientation shown in FIG. 13.

Figure 13:
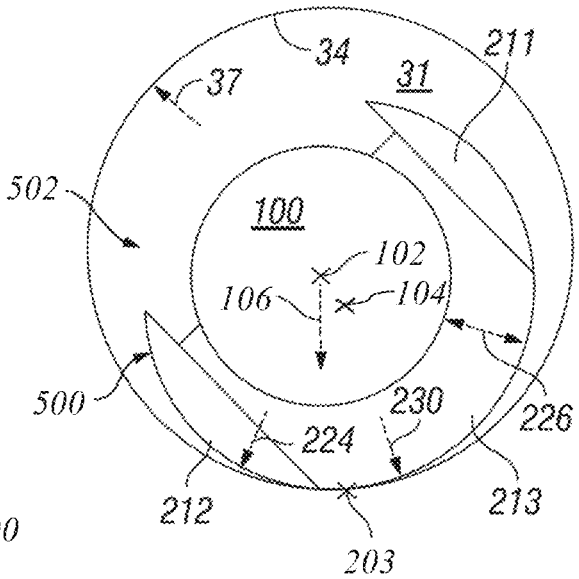

FIG. 13 shows the orienting tool 500 disposed within the passage 31 in a partially inverted position, in which the second and third orienting features 212, 213 are extending diagonally with respect to the downward direction such that one of the second and third orienting features are in contact with the bottom portion of the sidewall 34 along the contact point 203. The downhole assembly 502 is not stable in such orientation, because radii 224, 230 of the cross-sections of curved outer profiles 221, 232 of the second and third orienting features 212, 213 are smaller than the radius 37 of the cross-section of the sidewall 34 and, thus, unable to support or prop the downhole assembly 502 in such orientation. Also, the weight of the tool string 110, approximated by the downward force 106, is horizontally offset from the geometric centerline 104 of the downhole assembly 502 (and the contact point 203), thus urging further rotation of the downhole assembly 502. Accordingly, during conveying operations, if the downhole assembly 502 is introduced into or being conveyed along the passage 31 while oriented as shown in FIG. 13, the downhole assembly 502 can tend to further rotate, such as toward the orientation shown in FIG. 14.

Figure 14:
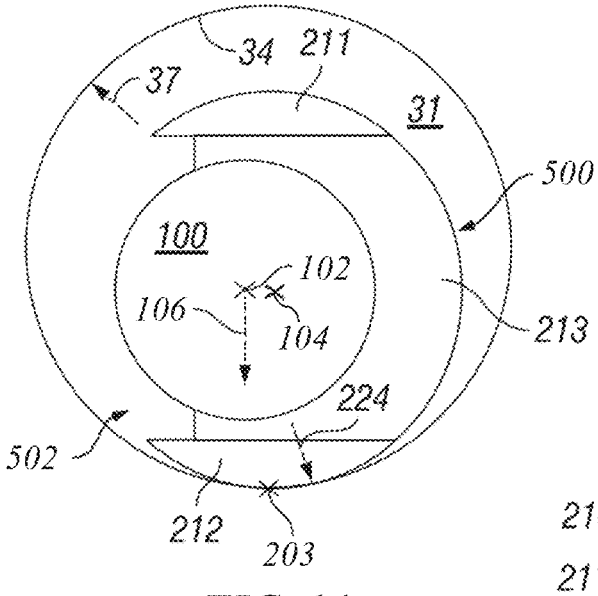

FIG. 14 shows the orienting tool 500 disposed within the passage 31 in a partially inverted position, in which the second orienting feature 212 is extending downwardly in the direction of gravity such that the second orienting feature 212 is in contact with the bottom portion of the sidewall 34 along the contact point 203. The downhole assembly 502 is not stable in such orientation, because the radius 224 of the cross-section of the curved outer profile 221 of the second orienting feature 212 is smaller than the radius 37 of the cross-section of the sidewall 34 and, thus, unable to support or prop the downhole assembly 502 in such orientation. Also, the weight of the tool string 110, approximated by the downward force 106, is horizontally offset from the geometric centerline 104 of the orienting tool 500 (and the contact point 203), thus urging further rotation of the downhole assembly 502. Accordingly, during conveying operations, if the downhole assembly 502 is introduced into or being conveyed along the passage 31 while oriented as shown in FIG. 14, the downhole assembly 502 can tend to further rotate, such as toward the orientation shown in FIG. 15.

Figure 15:
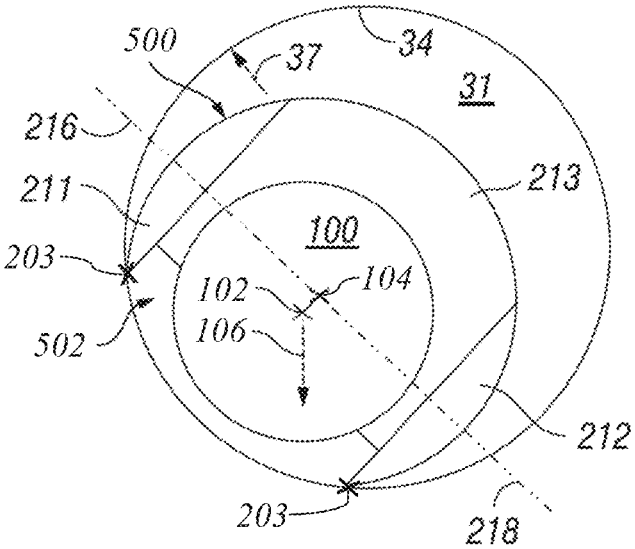

FIG. 15 shows the orienting tool 500 disposed within the passage 31 with the first and second orienting features 211, 212 in contact with the sidewall 34 of the passage 31 along the contact points 203. However the downhole assembly 502 is not in a stable orientation because the center of gravity of the tool string 100 is not at its closest distance from the bottom portion of the sidewall 34 directly below the geometric centerline 104 of the orienting tool 500. Also, the weight of the tool string 110, approximated by the downward force 106, is still horizontally offset from the geometric centerline 104 of the orienting tool 500, thus urging further rotation of the downhole assembly 502. Accordingly, during conveying operations, if the downhole assembly 502 is introduced into or being conveyed along the passage 31 while oriented as shown in FIG. 15, the downhole assembly 502 can tend to further rotate toward a more stable orientation, such as its most stable orientation in which the center of gravity, coinciding with the central axis 102, is located directly below the geometric centerline 104 of the orienting tool 500 and the axes of rotation 216, 218 of the orienting features 211, 212 extend substantially horizontally (i.e., perpendicularly with respect to the direction of gravity) above the central axis 102, e.g., as shown in FIGS. 6 and 10.

In view of the entirety of the present disclosure, including the figures and the claims, a person having ordinary skill in the art will readily recognize that the present disclosure introduces an apparatus comprising a downhole tool a downhole tool operable for detachably connecting with a tool string and orienting the tool string within a passage, wherein the passage is a wellbore or a tubular member disposed in the wellbore, and wherein the downhole tool comprises: a frame assembly comprising a first frame portion and a second frame portion, wherein the first and second frame portions are detachably connectable with each other around the tool string to detachably connect the frame assembly with the tool string; a first orienting feature rotatably connected with the first frame portion along a first axis of rotation; and a second orienting feature rotatably connected with the second frame portion along a second axis of rotation, wherein the first and second axes of rotation are radially offset from a central axis of the tool string when the downhole tool is detachably connected with the tool string.

The frame assembly may extend around a portion of a circumference of the tool string when the downhole tool is detachably connected with the tool string.

The frame assembly may extend around a majority of a circumference of the tool string when the downhole tool is detachably connected with the tool string.

The frame assembly may comprise an inner surface defining a void configured for receiving the tool string when the first and second frame portions are detachably connected. The downhole tool may comprise a spacer disposed between the inner surfaces of the frame assembly and the tool string, and the spacer may reduce cross-sectional size of the void to match an outer diameter of the tool string.

The first and second orienting features may each comprise a roller operable to roll axially along a sidewall of the passage.

The first orienting feature may comprise a first end cap having a first convex outer surface and covering a first axial bore in the first orienting feature, and the second orienting feature may comprise a second end cap having a second convex outer surface and covering a second axial bore in the second orienting feature. The first end cap defines at least a portion of a first internal space within the first orienting feature, the downhole tool may comprise a first fluid passage extending between a space external to the downhole tool and the first internal space, the first fluid passage may be configured to transfer a lubricant to a first friction reducing member located within the first internal space, the second end cap may define at least a portion of a second internal space within the second orienting feature, the downhole tool may comprise a second fluid passage extending between the space external to the downhole tool and the second internal space, and the second fluid passage may be configured to transfer a lubricant to a second friction reducing member located within the second internal space. The first fluid passage may extend at least partially through a first axle supporting the first orienting feature, and the second fluid passage may extend at least partially through a second axle supporting the second orienting feature. The first fluid passage may extend at least partially through the first frame portion, and the second fluid passage may extend at least partially through the second frame portion.

The downhole tool may comprise a third orienting feature connected with the first and/or second frame portions, and, when the downhole tool is detachably connected with the tool string: the first and second orienting features may extend radially outward from the tool string; and the third orienting feature may extend radially outwards from the tool string circumferentially between the first and second orienting features. Each of the first and second axes of rotation may interpose the central axis and the third orienting feature. The first and second orienting features may each extend radially outward from the tool string to a first distance, and the third orienting feature may extend radially outward from the tool string to a second distance that is appreciably greater than the first distance. The first and second axes of rotation being radially offset from the central axis may facilitate rotation of the connected downhole tool and tool string within a non-vertical portion of the passage toward a rotational orientation in which the central axis is below the first and second axes of rotation. The downhole tool may have a geometric centerline radially offset from the central axis such that the weight of the tool string facilitates rotation of the connected downhole tool and tool string within a non-vertical portion of the passage toward a rotational orientation in which the central axis is below the geometric centerline. The third orienting feature may extend beyond a portion of the first orienting feature in a first direction along the first axis of rotation, and the third orienting feature may extend beyond a portion of the second orienting feature in a second direction along the second axis of rotation. The first orienting feature may have a first curved outer profile, the second orienting feature may have a second curved outer profile, the third orienting feature may have a third curved outer profile, and the third curved outer profile may partially overlap with the first and second curved outer profiles. The first, second, and third orienting features may collectively form a substantially continuous curved outer profile extending at least partially around the circumference of the tool string. The substantially continuous curved outer profile may extend a radial distance from the central axis of the tool string, and the radial distance may progressively decrease from a midpoint of the third orienting feature toward each of the first and second orienting features. The substantially continuous curved outer profile may have a substantially circular cross-section. The substantially continuous curved outer profile may have a substantially elliptical cross-section. The substantially continuous curved outer profile may have a geometric centerline, and the geometric centerline may be radially offset from the central axis.

The present disclosure also introduces an apparatus comprising a downhole tool operable for detachably connecting to a tool string and maintaining an intended orientation of the tool string within a non-vertical portion of a passage extending into a subterranean formation when the tool string is conveyed within the passage, wherein the downhole tool comprises: a first orienting feature extending radially outward from the tool string and comprising a first curved outer profile; a second orienting feature extending radially outward from the tool string and comprising a second curved outer profile; and a third orienting feature extending radially outward from the tool string circumferentially between the first and second orienting features and comprising a third curved outer profile, wherein the third curved outer profile partially overlaps with the first and second curved outer profiles, and wherein the first, second, and third outer profiles collectively form a substantially continuous curved outer profile circumferentially extending partially around the tool string.

The downhole tool may comprise a frame assembly operable for detachably connecting with the tool string in a manner limiting or preventing movement of the frame assembly relative to the tool string, and the frame assembly may comprise: a first frame portion; and a second frame portion, wherein the first and second frame portions may be detachably connectable with each other around the tool string to connect the frame assembly with the tool string. The first orienting feature may be rotatably connected with the first frame portion, the second orienting feature may be rotatably connected with the second frame portion, and the third orienting feature may be connected with the first and/or second frame portions. The frame assembly may extend around a portion of a circumference of the tool string when connected with the tool string. The frame assembly may extend around a majority of a circumference of the tool string when connected with the tool string. The first and second frame portions may each comprise an inner surface collectively defining a void configured for receiving the tool string. The downhole tool may comprise a spacer disposed between the inner surfaces of the frame assembly and the tool string, and the spacer may reduce cross-sectional size of the void to match an outer diameter of the tool string.

The first and second orienting features may each comprise a roller operable to roll along a sidewall of the passage thereby facilitating axial movement of the connected downhole tool and tool string along the non-vertical portion of the passage.

The first orienting feature may comprise a first end cap having a first convex outer surface and covering a first axial bore in the first orienting feature, and the second orienting feature may comprise a second end cap having a second convex outer surface and covering a second axial bore in the second orienting feature. The first end cap may define at least a portion of a first internal space within the first orienting feature, the downhole tool may comprise a first fluid passage extending between a space external to the downhole tool and the first internal space, the first fluid passage may be configured to transfer a lubricant to a first friction reducing member located within the first internal space, the second end cap may define at least a portion of a second internal space within the second orienting feature, the downhole tool may comprise a second fluid passage extending between the space external to the downhole tool and the second internal space, and the second fluid passage may be configured to transfer a lubricant to a second friction reducing member located within the second internal space. The first fluid passage may extend at least partially through a first axle supporting the first orienting feature, and the second fluid passage may extend at least partially through a second axle supporting the second orienting feature.

The first and second orienting features may each be rotatable about an axis of rotation, and the axis of rotation may interpose a central axis of the tool string and the third orienting feature.

The first and second orienting features may each extend radially outward from the tool string to a first distance, and the third orienting feature may extend radially outward from the tool string to a second distance appreciably greater than the first distance.

The first and second orienting features may each be rotatable about an axis of rotation, and the axis of rotation may be radially offset from a central axis of the tool string to urge rotation of the connected downhole tool and tool string within the non-vertical portion of the passage toward a rotational orientation in which the central axis is below the axis of rotation.

The substantially continuous curved outer profile may have a geometric centerline radially offset from a central axis of the tool string such that the weight of the tool string urges rotation of the connected downhole tool and tool string within the non-vertical portion of the passage toward a rotational orientation in which the central axis is below the geometric centerline.

The first and second orienting features may each be rotatable about an axis of rotation, the third orienting feature may extend beyond a portion of the first orienting feature in a first direction along the axis of rotation, and the third orienting feature may extend beyond a portion of the second orienting feature in a second direction along the axis of rotation.

The substantially continuous curved outer profile may extend a radial distance from a central axis of the tool string, and the radial distance may progressively decrease from a midpoint of the third orienting feature toward each of the first and second orienting features.

The substantially continuous curved outer profile may have a substantially circular cross-section.

The substantially continuous curved outer profile may have a substantially elliptical cross-section.

The substantially continuous curved outer profile may have a geometric centerline radially offset from a central axis of the tool string.

The present disclosure also introduces a method comprising: (A) coupling an apparatus to a tool string, wherein the apparatus comprises: (i) a first frame portion; (ii) a second frame portion; (iii) a first orienting feature rotatably connected with the first frame portion; and (iv) a second orienting feature rotatably connected with the second frame portion, wherein coupling the apparatus to the tool string comprises detachably connecting the first frame portion and the second frame portion with each other around the tool string, and wherein, when the apparatus is coupled to the tool string, a cross section of the apparatus has a geometric centerline that is radially offset from a central axis of the tool string; and (B) conveying the coupled tool string and apparatus within a non-vertical portion of a passage extending into a subterranean formation while the radial offset and weight of the tool string collectively facilitate rotation of the coupled tool string and apparatus toward a rotational orientation in which the central axis is below the geometric centerline.

When coupled to the tool string, the first and second frame portions of the apparatus may collectively extend around a portion of a circumference of the tool string.

Detachably connecting the first frame portion and the second frame portion with each other may comprise: extending a plurality of bolts through corresponding holes in one of the first and second frame portions; and threadedly engaging the plurality of bolts with another of the first and second frame portions.

Coupling the apparatus to the tool string may comprise threading a setscrew through a threaded hole extending through a wall of the first and/or second frame portions to engage the setscrew against the tool string.

Coupling the apparatus to the tool string may comprise disposing a spacer between the tool string and each of the first and second frame portions.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a downhole tool operable for detachably connecting with a tool string and orienting the tool string within a passage, wherein the passage is a wellbore or a tubular member disposed in the wellbore, and wherein the downhole tool comprises:

a frame operable to detachably connect with the tool string to detachably connect the downhole tool with the tool string;

a first orienting feature rotatably connected with the frame and comprising a first curved axial profile extending partially around the tool string when the downhole tool is detachably connected with the tool string, wherein the first orienting feature is rotatable about a first axis of rotation;

a second orienting feature rotatably connected with the frame and comprising a second curved axial profile extending partially around the tool string when the downhole tool is detachably connected with the tool string, wherein the second orienting feature is rotatable about a second axis of rotation; and a third orienting feature connected with the frame and comprising a third curved axial profile extending partially around the tool string at least partially between the first and second curved axial profiles when the downhole tool is detachably connected with the tool string, wherein a first portion of the third orienting feature projects beyond at least a portion of the first orienting feature in a first direction along the first axis of rotation, wherein a second portion of the third orienting feature projects beyond at least a portion of the second orienting feature in a second direction along the second axis of rotation, and wherein the first and second portions of the third orienting feature are each detachably connectable with a central portion of the third orienting feature on opposing sides of the central portion of the third orienting feature.

2. The apparatus of claim 1 wherein the third curved axial profile overlaps with a portion of each of the first and second curved axial profiles, and wherein the first, second, and third curved axial profiles collectively form a substantially continuous curved axial profile extending at least partially around a circumference of the tool string when the downhole tool is detachably connected with the tool string.

3. The apparatus of claim 1 wherein the first and second axes of rotation each interpose the third orienting feature and a central axis of the tool string when the downhole tool is detachably connected with the tool string.

4. The apparatus of claim 1 wherein the frame comprises:

a first frame portion; and a second frame portion, wherein the first and second frame portions are detachably connectable with each other around the tool string to detachably connect the downhole tool with the tool string.

5. The apparatus of claim 1 wherein the first, second, and third orienting features collectively form a substantially continuous curved axial profile extending at least partially around a circumference of the tool string when the downhole tool is detachably connected with the tool string, and wherein the substantially continuous curved axial profile has a geometric center that is radially offset from a central axis of the tool string when the downhole tool is detachably connected with the tool string.

6. An apparatus comprising:

a downhole tool operable for detachably connecting with a tool string and orienting the tool string within a passage, wherein the passage is a wellbore or a tubular member disposed in the wellbore, and wherein the downhole tool comprises:

a frame operable to detachably connect with the tool string to detachably connect the downhole tool with the tool string, wherein the frame comprises:

a first frame portion; and a second frame portion, wherein the first and second frame portions are detachably connectable with each other around the tool string to detachably connect the downhole tool with the tool string, wherein the frame extends around a portion of a circumference of the tool string when the downhole tool is detachably connected with the tool string, and wherein the frame does not extend around the entirety of the circumference of the tool string when the downhole tool is detachably connected with the tool string;

a first orienting feature rotatably connected with the frame, wherein the first orienting feature is rotatable about a first axis of rotation; and a second orienting feature rotatably connected with the frame, wherein the second orienting feature is rotatable about a second axis of rotation, and wherein the first and second axes of rotation are each radially offset from a central axis of the tool string when the downhole tool is detachably connected with the tool string.

7. The apparatus of claim 6 wherein the first orienting feature is rotatably connected with the first frame portion, and wherein the second orienting feature is rotatably connected with the second frame portion.

8. An apparatus of claim 6 wherein:

the first orienting feature comprises a first curved axial profile extending partially around the tool string when the downhole tool is detachably connected with the tool string;

the second orienting feature comprises a second curved axial profile extending partially around the tool string when the downhole tool is detachably connected with the tool string; and the downhole tool further comprises a third orienting feature connected with the frame and comprising a third curved axial profile extending partially around the tool string at least partially between the first and second curved axial profiles when the downhole tool is detachably connected with the tool string.

9. The apparatus of claim 8 wherein the first, second, and third curved axial profiles collectively form a substantially continuous curved axial profile extending at least partially around the circumference of the tool string when the downhole tool is detachably connected with the tool string.

10. The apparatus of claim 9 wherein the substantially continuous curved axial profile has a geometric centerline offset from the central axis of the tool string when the downhole tool is detachably connected with the tool string such that the weight of the tool string facilitates rotation of the downhole tool and tool string within a non-vertical portion of the passage toward a rotational orientation in which the central axis is below the geometric centerline.

11. The apparatus of claim 9 wherein the substantially continuous curved axial profile extends around a majority of the circumference of the tool string when the downhole tool is detachably connected with the tool string.

12. The apparatus of claim 8 wherein the third curved axial profile overlaps with a portion of each of the first and second curved axial profiles, and wherein the first, second, and third curved axial profiles collectively form a substantially continuous curved axial profile extending at least partially around the circumference of the tool string when the downhole tool is detachably connected with the tool string.

13. The apparatus of claim 8 wherein the third curved axial profile extends over each of a first space located between the first and third orienting features and a second space located between the second and third orienting features, and wherein the first, second, and third curved axial profiles collectively form a substantially continuous curved axial profile extending at least partially around the circumference of the tool string when the downhole tool is detachably connected with the tool string.

14. The apparatus of claim 8 wherein the third curved axial profile extends beyond at least a portion of the first curved axial profile in a first direction along the first axis of rotation, and wherein the third curved axial profile extends beyond at least a portion of the second curved axial profile in a second direction along the second axis of rotation.

15. The apparatus of claim 8 wherein the third orienting feature comprises a first portion that projects beyond at least a portion of the first orienting feature in a first direction along the first axis of rotation, wherein the third orienting feature further comprises a second portion that projects beyond at least a portion of the second orienting feature in a second direction along the second axis of rotation, and wherein the first and second portions of the third orienting feature are each detachably connectable with a central portion of the third orienting feature on opposing sides of the central portion of the third orienting feature.

16. An apparatus comprising:

a downhole tool operable for detachably connecting with a tool string and orienting the tool string within a passage, wherein the passage is a wellbore or a tubular member disposed in the wellbore, and wherein the downhole tool comprises:

a frame operable to detachably connect with the tool string to detachably connect the downhole tool with the tool string, wherein the frame extends around a portion of the circumference of the tool string when the downhole tool is detachably connected with the tool string, wherein the frame does not extend around the entirety of the circumference of the tool string when the downhole tool is detachably connected with the tool string, and wherein the frame comprises:

a first frame portion; and a second frame portion, wherein the first and second frame portions are detachably connectable with each other around the tool string to detachably connect the downhole tool with the tool string;

a first orienting feature rotatably connected with the frame and comprising a first curved axial profile extending partially around the tool string when the downhole tool is detachably connected with the tool string;

a second orienting feature rotatably connected with the frame and comprising a second curved axial profile extending partially around the tool string when the downhole tool is detachably connected with the tool string; and a third orienting feature connected with the frame and comprising a third curved axial profile extending partially around the tool string at least partially between the first and second curved axial profiles when the downhole tool is detachably connected with the tool string, wherein the downhole tool has a geometric centerline radially offset from a central axis of the tool string when the downhole tool is detachably connected with the tool string such that the weight of the tool string facilitates rotation of the downhole tool and tool string within a non-vertical portion of the passage toward a rotational orientation in which the central axis is below the geometric centerline, wherein the first, second, and third curved axial profiles collectively form a substantially continuous curved axial profile extending at least partially around a circumference of the tool string when the downhole tool is detachably connected with the tool string, and wherein the substantially continuous curved axial profile has the geometric centerline.

17. The apparatus of claim 16 wherein the substantially continuous curved axial profile extends around a majority of the circumference of the tool string when the downhole tool is detachably connected with the tool string.

18. The apparatus of claim 16 wherein the third curved axial profile extends substantially entirely between the first and second curved axial profiles.

19. The apparatus of claim 16 wherein the third curved axial profile overlaps with a portion of each of the first and second curved axial profiles.

20. An apparatus comprising:

a downhole tool operable for detachably connecting with a tool string and orienting the tool string within a passage, wherein the passage is a wellbore or a tubular member disposed in the wellbore, and wherein the downhole tool comprises:

a frame operable to detachably connect with the tool string to detachably connect the downhole tool with the tool string;

a first orienting feature rotatably connected with the frame and comprising a first curved axial profile extending partially around the tool string when the downhole tool is detachably connected with the tool string;

a second orienting feature rotatably connected with the frame and comprising a second curved axial profile extending partially around the tool string when the downhole tool is detachably connected with the tool string; and a third orienting feature connected with the frame and comprising a third curved axial profile extending partially around the tool string at least partially between the first and second curved axial profiles when the downhole tool is detachably connected with the tool string;

wherein the downhole tool has a geometric centerline radially offset from a central axis of the tool string when the downhole tool is detachably connected with the tool string such that the weight of the tool string facilitates rotation of the downhole tool and tool string within a non-vertical portion of the passage toward a rotational orientation in which the central axis is below the geometric centerline;

wherein the third curved axial profile extends over each of a first space located between the first and third orienting features and a second space located between the second and third orienting features; and wherein the first, second, and third curved axial profiles collectively form a substantially continuous curved axial profile extending at least partially around a circumference of the tool string when the downhole tool is detachably connected with the tool string.

21. An apparatus comprising:

a downhole tool operable for detachably connecting with a tool string and orienting the tool string within a passage, wherein the passage is a wellbore or a tubular member disposed in the wellbore, and wherein the downhole tool comprises:

a frame operable to detachably connect with the tool string to detachably connect the downhole tool with the tool string;

a first orienting feature rotatably connected with the frame and comprising a first curved axial profile extending partially around the tool string when the downhole tool is detachably connected with the tool string, wherein the first orienting feature is rotatable about a first axis of rotation;

a second orienting feature rotatably connected with the frame and comprising a second curved axial profile extending partially around the tool string when the downhole tool is detachably connected with the tool string, wherein the second orienting feature is rotatable about a second axis of rotation; and a third orienting feature connected with the frame and comprising a third curved axial profile extending partially around the tool string at least partially between the first and second curved axial profiles when the downhole tool is detachably connected with the tool string, wherein the third curved axial profile extends beyond at least a portion of the first curved axial profile in a first direction along the first axis of rotation, wherein the third curved axial profile extends beyond at least a portion of the second curved axial profile in a second direction along the second axis of rotation, and wherein the downhole tool has a geometric centerline radially offset from a central axis of the tool string when the downhole tool is detachably connected with the tool string such that the weight of the tool string facilitates rotation of the downhole tool and tool string within a non-vertical portion of the passage toward a rotational orientation in which the central axis is below the geometric centerline.

22. An apparatus comprising:

a downhole tool operable for detachably connecting with a tool string and orienting the tool string within a passage, wherein the passage is a wellbore or a tubular member disposed in the wellbore, and wherein the downhole tool comprises:

a frame operable to detachably connect with the tool string to detachably connect the downhole tool with the tool string;

a first orienting feature rotatably connected with the frame and comprising a first curved axial profile extending partially around the tool string when the downhole tool is detachably connected with the tool string, wherein the first orienting feature is rotatable about a first axis of rotation;

a second orienting feature rotatably connected with the frame and comprising a second curved axial profile extending partially around the tool string when the downhole tool is detachably connected with the tool string, wherein the second orienting feature is rotatable about a second axis of rotation; and a third orienting feature connected with the frame and comprising a third curved axial profile extending partially around the tool string at least partially between the first and second curved axial profiles when the downhole tool is detachably connected with the tool string, wherein:

the third orienting feature comprises a first portion that projects beyond at least a portion of the first orienting feature in a first direction along the first axis of rotation;

the third orienting feature further comprises a second portion that projects beyond at least a portion of the second orienting feature in a second direction along the second axis of rotation;

the first and second portions of the third orienting feature are each detachably connectable with a central portion of the third orienting feature on opposing sides of the central portion of the third orienting feature; and the downhole tool has a geometric centerline radially offset from a central axis of the tool string when the downhole tool is detachably connected with the tool string such that the weight of the tool string facilitates rotation of the downhole tool and tool string within a non-vertical portion of the passage toward a rotational orientation in which the central axis is below the geometric centerline.

* * * * *